United States Patent [19]

Suzuki

[11] Patent Number: 5,061,936

[45] Date of Patent: Oct. 29, 1991

[54] ATTITUDE CONTROL SYSTEM FOR MOBILE ANTENNA

[75] Inventor: Katsuo Suzuki, Tokyo, Japan

[73] Assignees: Aisin Seiki K.K., Aichi; K.K. Shinsangyo, Tokyo, both of Japan

[21] Appl. No.: 582,734

[22] Filed: Sep. 14, 1990

[30] Foreign Application Priority Data

Sep. 14, 1989 [JP] Japan ..... 1-238677
Sep. 14, 1989 [JP] Japan ..... 1-238678

[51] Int. Cl.[5] ..... H01Q 3/00

[52] U.S. Cl. ..... 342/359; 343/713; 318/649

[58] Field of Search ..... 342/75, 359; 343/713; 318/649

[56] References Cited

U.S. PATENT DOCUMENTS 4,725,843 2/1988 Suzuki et al. ..... 342/359
4,873,527 10/1989 Katsuo ..... 342/359

*Primary Examiner*—Mark Hellner
*Attorney, Agent, or Firm*—Sughrue, Mion, Zinn Macpeak & Seas

[57] ABSTRACT

The attitude of an antenna which is used with an artificial satellite emitting a radio wave is controlled by a combination of the establishment of an antenna attitude in accordance with gyro data, a small range conical scan which is conducted when a reception level is less than a first reference and at or above a second reference and is relatively high for altering the antenna attitude to a direction which provides a higher reception level, and a broader range search scan which is conducted when the reception level is less than the second reference and is relatively low for altering the antenna attitude to a direction which provides a higher reception level. In one manner, in order to reduce an antenna driving time, an antenna attitude is regarded as an optimum if a fluctuation which occurs in the reception level during the small range conical scan is small, and the first reference is updated to a value which is slightly less than a maximum value in the reception levels which are obtained during the conical scan. In second manner, the first reference is a fixed value, and as long as the reception level continuously remains at or above a given value, which may be the first reference, for example, gyro data is initialized at a given time interval in order to prevent an accumulated error in gyro data from increasing. In other words, data representing a start point and a variance from the start point are cleared.

3 Claims, 24 Drawing Sheets initial search
50
A1, A2 ← Az data
E1, E2 ← Eℓ data
51
F1 ← 0
52
L1 ← reception level
53
L1>TH1 ?
YES
Return
NO
54
F1=0 ?
NO
61
YES
55
59D ON ?
YES
59U ON ?
56
NO
NO
YES
F1 ← 0
1 step up shift commanded
58
F1 ← 1
62
1 step up shift commanded
59
1 step right shift commanded
63
57
E2 ← E2+1
A2 ← A2+1
60
E2 ← E2-1
64
shift complete ?
YES
A1=A2, E1=E2 ?
NO
NO
66
YES
65
67
reception disabled displayed
A 16
tracking search 100
TSC ← 0
4
101
TSC≦4 ?
YES
NO
102
59U ON ?
YES
NO
103
1 step up commanded
104
TSC≦54 ?
YES
NO
105
1 step right commanded
106
TSC≦64 ?
YES
NO
107
59D ON ?
YES
NO
108
1 step down commanded
109
TSC≦164 ?
YES
NO
110
1 step left commanded
111
TSC≦174 ?
YES
NO
112
59U ON ?
YES
NO
113
1 step up commanded
114
TSC≦224 ?
YES
NO
115
1 step right commanded
116
TSC≦229 ?
YES
NO
117
59D ON ?
YES
NO
118
1 step down commanded
119
TSC ← 0
3

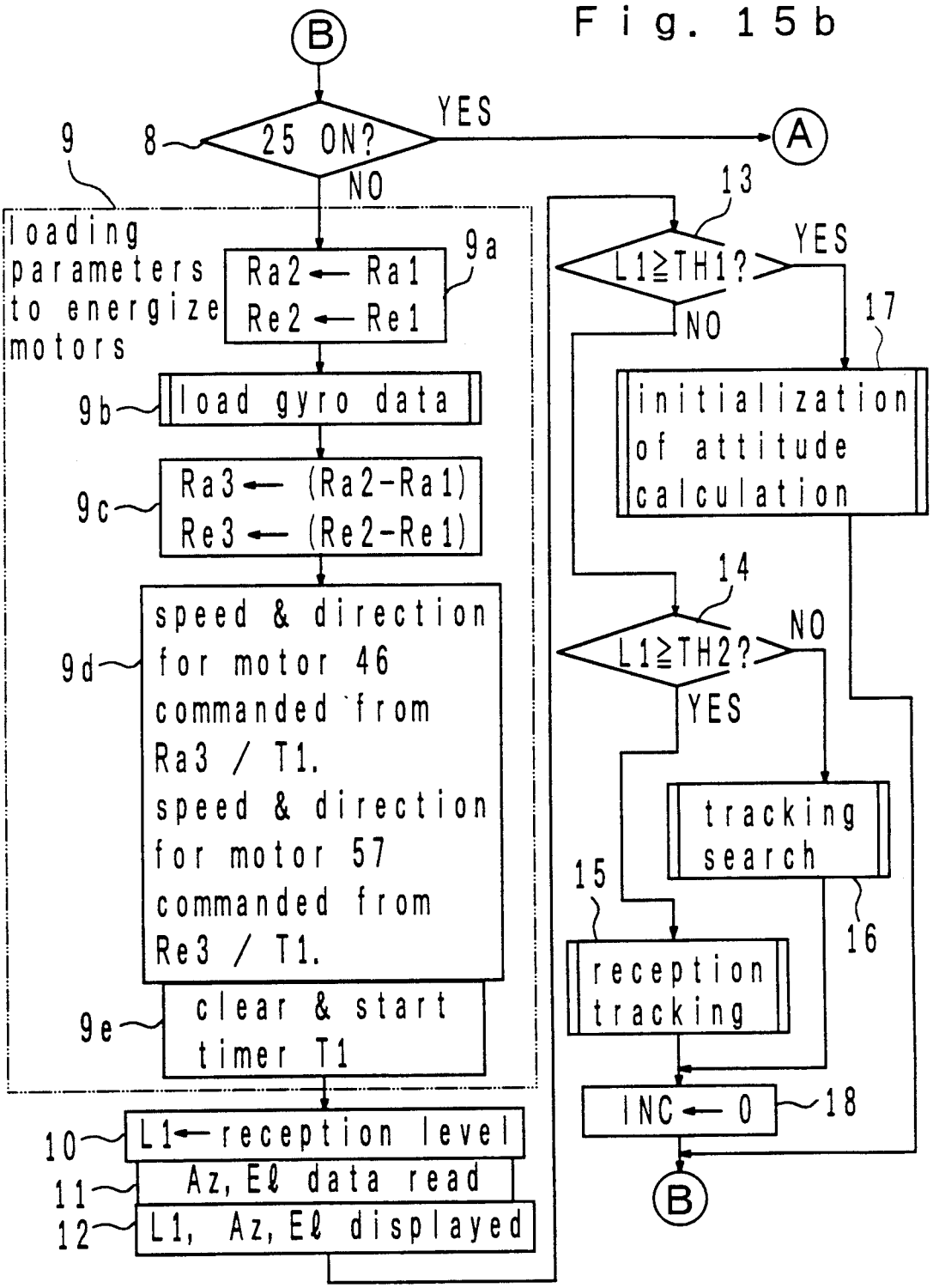
Fig. 15b
B
25 ON?
YES
A
NO
8
9
loading parameters to energize motors
Ra2 ← Ra1
Re2 ← Re1
9a
load gyro data
9b
Ra3 ← (Ra2-Ra1)
Re3 ← (Re2-Re1)
9c
speed & direction for motor 46 commanded from Ra3 / T1.
speed & direction for motor 57 commanded from Re3 / T1.
9d
clear & start timer T1
9e
L1 ← reception level
10
Az, El data read
11
L1, Az, El displayed
12
13
L1≧TH1?
YES
NO
17
initialization of attitude calculation
14
L1≧TH2?
NO
YES
tracking search
15
16
reception tracking
INC ← 0
18
B

ATTITUDE CONTROL SYSTEM FOR MOBILE ANTENNA

FIELD OF THE INVENTION

The invention relates to an attitude control of a mobile antenna, and in particular, to an attitude control of a directional antenna on a moving vehicle which is configured to track a source of radio wave.

PRIOR ART

An antenna may be mounted on a road vehicle, a marine vessel, an aircraft or other moving vehicle, hereafter collectively referred to as a vehicle, for purpose of providing a mobile communication, the reception of a television or radio broadcasting, or for a communication with a stationary station or artificial satellite to enable the recognition of its own position.

To maintain a directional antenna oriented to a given source of radio wave or to a radio wave reflector, a number of techniques have been employed in the prior art for controlling the attitude of an antenna:

1) Gyro sensors are used to recognize the position and attitude of a moving vehicle, and the attitude of the antenna is controlled to cancel out any deviation in the directivity of the antenna which may be caused by a change in the position and attitude of a moving vehicle. (See U.S. Pat. No. 4,725,843 issued Febr. 16, 1988, to Katsuo Suzuki et al., for example).

2) A conical scan technique may be employed to drive an antenna in a scan operation while actually receiving a radio wave, and a source of radio wave is searched for and tracked in accordance with a reception level. When a given reception level is attained, the tracking operation may be put in a pause, or only a continuous roving tracking operation may be interrupted. (See, for example, Japanese Laid-Open Patent Application No. 1-161997 (161997/1989), Katsuo Suzuki as the inventor).

3) A combination of the procedures 1) and 2). Specifically, in an open area, the motion of a vehicle is detected to provide a correction for the attitude of the antenna, and any resulting error is corrected for by the procedure 2). Such example is disclosed in U.S. Pat. No. 4,725,843 cited above.

However, in the attitude control of the antenna according to the procedure 2), a difficulty is experienced when a threshold for the reception level which is relied upon in determining the need to scan the antenna is chosen high. In this instance, a bad weather may result in a reception level which is below the threshold, requiring a continued antenna scan and causing a wasteful power dissipation and abrasion of mechanical parts. On the contrary, if a low threshold is chosen, an antenna scan operation may not be initiated even though a higher reception level can be achieved. It is therefore desirable that an antenna attitude control system be capable of receiving a desired radio wave at as high a reception level as possible while minimizing the possibility of a wasteful antenna scan operation for any change in the reception level which may be caused as by a change in the weather.

According to the procedure 1), it is highly difficult to detect a motion of a vehicle exactly with available means. If the precision of detection of such means is to be improved, the means must be complex and expensive, presenting a difficulty in its practical use. In addition, the procedure 2) suffers from a drawback that it fails to operate when the attitude or directivity of the antenna largely deviates from the source of radio source as when the reception is interrupted by the presence of a mountain, a tunnel, a building or other obstacles. The arrangement can be simplified and reduced in size according to this procedure when a continuous roving technique is adopted, but there is a difficulty in increasing the tracking rate. While a high tracking rate can be expected if a mono-pulse technique is employed, this results in a complicated arrangement and makes it difficult to achieve a reduction in the size and to reduce the cost.

The procedure 3) in which the attitude of the antenna is controlled to maintain it directed toward the source of radio wave gains complementary advantages that the tracking procedure 1) may be used where the reception is hindered by the presence of an obstacle while a correction according to the procedure 2) is available for any error in detecting the attitude of the vehicle under the procedure 1) if a favorable reception prevails. However, with this procedure, while the procedure 2) may be employed to correct an offset in the directivity of the antenna momentarily, an accumulated error of gyro cannot be compensated for, resulting in a degradation in the tracking precision. When the accumulated error increases, the tracking operation according to the procedure 1) may result in driving the antenna out of a range in which the antenna can be tracked according to the procedure 2).

SUMMARY OF THE INVENTION

It is a first object of the invention to enable a reception at as high a reception level as possible while automatically avoiding a substantially wasteful automatic tracking operation.

It is a second object of the invention to resume an automatic tracking operation rapidly and reliably whenever the reception becomes possible again after the reception has once been disabled by the presence of an obstacle.

It is a third object of the invention to prevent a disorder or delay in the automatic tracking operation which may be caused by an accumulated error in a detection by attitude detecting means.

The first object of the invention is accomplished according to an attitude control system for mobile antenna according to the invention, comprising an antenna (31, 32) which is mounted on a moving vehicle (CAR) so as to be capable of changing its attitude; a drive mechanism (46, 57) for altering the attitude of the antenna; reception level detecting means (5*a*, 5*b*, 5*c*) for detecting the reception level from the antenna; and electronic control means (1) for performing a small range scan control in which the antenna is scanned over a small range and its attitude is altered in a direction to increase the resulting reception level when the reception level is less than a first reference (TH1) and greater than a second reference (TH2), performing a search control in which the antenna is scanned over a broader range than the small range scan when the reception level is less than the second reference (TH2), and performing a reference update in which a fluctuation (HR-LR) in the reception level during the small range scan is detected, and if the fluctuation is less than a third reference (TH3), the first reference (TH1) is updated to a value (0.9 HR) which is slightly less than a high value (HR) obtained during the small range scan. Numerals and characters appearing in the parentheses represent corresponding numerals or characters used in the following description of a first embodiment to be described later.

(IA) In accordance with the invention, when the reception level is less than the first reference (TH1) and equal to or greater than the second reference (TH2), electronic control means (1) is operative to conduct a scan of the antenna (31, 32) in a small range (see FIG. 13), altering the attitude of the antenna (31, 32) in a direction to obtain a higher reception level. When the reception level becomes equal to or greater than the first reference (TH1) as a result of such scan, the antenna scan ceases to operate.

(IIA) When the reception level drops below the second reference as a result of the presence of an obstacle or a rapid change in the attitude of the vehicle, the electronic control means (1) conducts a search scan (see FIG. 14) in which the antenna (31, 32) is scanned over a broader range than the small range scan of FIG. 13. When the reception level becomes equal to or greater than the second reference (TH2) as a result of the search scan, the scan (IA) follows. The search scan (IIA) is continued as long as the reception level remains below the second reference (TH2).

As long as the vehicle is moving around an area which is free from any obstacle with a relatively slow change in its attitude, the small range scan (IA) takes place whenever the reception level reduces below the first reference (TH1), and the antenna scan ceases to operate when the reception level becomes equal to or greater than the first reference (TH1).

If the directivity of the antenna largely deviates from its intended direction with respect to the source of radio wave as a result of the presence of an obstacle or as a result of failure of the antenna attitude control to respond to a rapid change in the attitude of the vehicle, the search scan (IIA) is initiated until the reception level becomes equal to or greater than the second reference (TH2). Accordingly, the scan (IA) is automatically resumed whenever there is no longer any obstacle or when a rapid change in the attitude of a vehicle ceases to occur.

In this manner, the search scan (IIA) functions to detect automatically a change in the status from the inability to the ability to receive the radio wave and to establish automatically an attitude of the antenna with which a tracking operation is enabled by means of the small range scan. With the search scan (IIA), the continuity of the automatic tracking operation is automatically assured if the rate with which the attitude of the antenna is controlled is retarded with respect to a rapid change in the attitude of the vehicle, thereby achieving an automatic tracking operation which is practically satisfactory without requiring an especially high response of an antenna attitude control system.

(IIIA) In the scan (IA), the electronic control means (1) detects a fluctuation (HR-LR) in the reception level during the small range scan (see FIG. 13), and if the fluctuation (HR-LR) is less than a third reference (TH3), the first reference (TH1) is updated to a value (0.9 HR) which is slightly less than the high value (HR) of the reception level which prevails during the small range scan (FIG. 13).

When the fluctuation (HR-LR) is equal to or greater than the third reference (TH3), there may be found a direction in which a higher reception level is attained. Also it is possible that the field of received radio wave undergoes a variation and becomes unstable as a result of a sudden change in the weather or the obstacle which occurs during the small range scan. In this instance, the first reference (TH1) is not updated, and therefore there is a high possibility that the attitude of the antenna may be controlled to a direction in which a higher reception level is obtained when the small range scan is subsequently repeated. Alternatively, the possibility is high that the reception level may be detected under the stable condition of the field of radio wave.

The fact that the fluctuation (HR-LR) is less than the third reference (TH3) means that the directivity of the antenna is well arranged with the oncoming direction of the radio wave and the reception is stabilized. Since the first reference (TH1) is updated to a value which is slightly less than the high value of the reception level, this first reference (TH1) has a high reliability. In addition, because the threshold (TH1) which is used to determine the initiation of the small range scan of the antenna shifts automatically, a wasteful scan can be avoided when the field of the radio wave changes as a result of a variation in the weather or the like. In addition, an inconvenience that the attitude may be fixed in direction to assure a low level reception can be avoided when the antenna can be directed to achieve a higher reception level.

The second and the third object of the invention can be achieved by an attitude control system for mobile antenna according to the invention, comprising an antenna (31, 32) mounted on a moving vehicle so as to be capable of changing its attitude; a drive mechanism (46, 57) for altering the attitude of the antenna (31, 32); reception level detecting means (5*a*, 5*b*, 5*c*) for detecting the reception level from the antenna; attitude detecting means (GYrp, GYya) for detecting a change in the attitude of the moving vehicle (CAR) from its start point; and electronic control means (1) for performing a first control in which the attitude of the antenna is altered to compensate for an offset in the directivity of the antenna responsive to a change detected by the attitude detecting means (GYrp, GYya), a second control for conducting a small range scan (see FIG. 13) of the antenna and for altering the attitude thereof to a direction where a higher reception level prevails when the reception level is less than the first reference (TH1) and equal to or greater than the second reference (TH2), a third control in which a search scan (see FIG. 14) of the antenna is conducted over a broader range than that of the small range scan (FIG. 13) when the reception level is less than the second reference (TH2), and a fourth control in which an accumulated error in the change is compensated for by resetting the relationship between the start point and the change of the attitude detecting means (GYrp, GYya) at a given time interval as long as the reception level remains at or above a given value (TH1) which may or may not be equal to the first reference (TH1).

In the above description, numerals and characters appearing in the parentheses refer to corresponding numerals and characters used in the drawings to denote elements of a second embodiment to be described later.

With this embodiment, (IB) as long as the reception level from the antenna (31, 32) is at or above the first reference (TH1), the electronic control means (1) does not conduct the small range scan nor the search scan, but conducts the first control, by establishing the attitude of the antenna (31, 32) so as to compensate for an offset in the directivity of the antenna responsive to a change in the detected value from the attitude detecting means (GYrp, GYya).

Accordingly, as long as the reception is successful, no antenna scan takes place, but a minimum amount of antenna drive which is required to compensate for an offset in the directivity which may be caused by a change in the attitude of vehicle is conducted.

(IIB) When the reception level becomes less than the first reference (TH1) and equal to or greater than the second reference (TH2) as a result of accumulated error in the detection by the attitude detecting means (GYrp, GYya) or of an accumulated error in the antenna attitude or accumulated response delay, or in other words, if the reception level slightly decreases below an optimum value, the electronic control means (1) conducts the second control, performing a small range scan (see FIG. 13) of the antenna (31, 32), altering the attitude of the antenna to a direction where a maximum reception level can be obtained. If the reception level increases to or above the first reference (TH1) as a result of this, the operation returns to (IB). If the reception level is less than the first reference (TH1) an is equal to or greater than the second reference (TH2), the operation returns to (IIB).

(IIIB) If the reception level reduces below the second reference as a result of the presence of an obstacle or as a result of a rapid change in the attitude of the vehicle, the electronic control means (1) conducts the third control, performing the search scan (see FIG. 14) of the antenna (31, 32) over a broader range than that of the small range scan (FIG. 13). When the reception level resumes to or above the second reference (TH2) as a result of the search scan, the operation returns to (IIB). The operation (IIIB) is continued as long as the reception level remains below the second reference (TH2).

(IV) As long as the reception level is at or above a given value (TH1), the electronic control means (1) resets the relationship between the start point and the detected change from the attitude detecting means by conducting the fourth control at a given time interval. In this manner, any accumulated error in the detected change can be cleared, preventing the detected error from being accumulated unduly. As a consequence, the chance of a failure of tracking during the small range scan (IB) and associated search scan (IIB), which is attributed to and initiated by the accumulation of the detected error, cannot virtually occur.

From the foregoing, it will be seen that when the vehicle is moving in an area which is free from any obstacle, with a relatively slow change in the attitude, the attitude control (IB) or (IIB) takes place. If an error in controlling the antenna attitude or response delay accumulates (or if the reception level reduces below the first reference), the attitude control (IIB) is conducted automatically, thus automatically clearing an accumulated error (or returning reception level to or above the first reference TH1). Accordingly an automatic tracking operation which is satisfactory for practical purposes can be realized without requiring an especially high response of the antenna attitude control system.

If the directivity of the antenna with respect to the source of radio wave largely deviates as a result of the presence of an obstacle or of a failure of the antenna attitude control to respond rapidly enough to a change in the attitude of the vehicle, the control (IIIB) is initiated and continued until the reception level returns to or above the second reference (TH2). Accordingly, when an obstacle ceases to be present or the vehicle ceases to change its attitude rapidly, the operation automatically resumes (IIB), then followed by (IB).

In this manner, the control (IIIB) has the function of automatically detecting a change in the status from the inability to the ability to receive and of automatically establishing an antenna attitude which enables a tracking operation by a conical scan across the small range. Thus, the control (IIIB) automatically assures the continuity of the automatic tracking operation if the rate with which the antenna attitude can be controlled is retarded with respect to a rapid change in the attitude of the vehicle, thus realizing an automatic tracking operation which is satisfactory for practical purposes without requiring an especially high response of the antenna attitude control system. The control (IV) permits means (GYrp, GYya) for tracking the attitude of the vehicle to be employed which are relatively simple in construction and susceptible to a detection error of an increased magnitude without causing practical problems.

As a consequence of the described arrangement, an automatic operation can be rapidly and reliably resumed as soon as the reception becomes possible after it has once been disabled by the presence of an obstacle, preventing a disorder or delay in the automatic tracking operation which may be caused by the accumulated error from the attitude detecting means (GYrp, GYya).

Other objects, features and advantages of the invention will become apparent from the following description of several embodiments thereof with reference to the drawings.

BRIEF DESCRIPTION OF THE DRAWINGS

FIGS. 15*a* and 15*b* are flow charts illustrating the operation of a microcomputer 1 in a second embodiment of the invention, which views correspond to FIGS. 5*a* and 5*b* associated with the first embodiment;

DESCRIPTION OF PREFERRED EMBODIMENTS

First Embodiment

Figure 1:
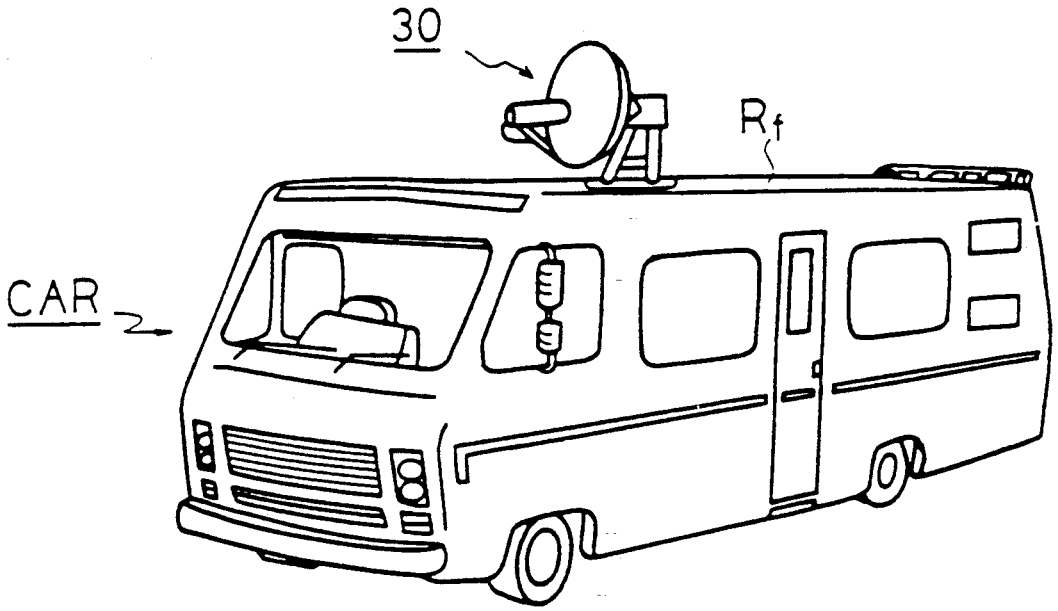
FIG. 1 is a perspective view of the appearance of a first embodiment of the invention.

FIG. 1 shows the appearance of a first embodiment of the invention. In FIG. 1, a moving vehicle CAR carries an antenna for receiving a satellite broadcasting (hereafter simply referred to as an antenna) 30 on its roof Rf. In the present embodiment, the antenna 30 comprises a parabola antenna which is commercially available for receiving a satellite broadcasting.

Figure 3A:
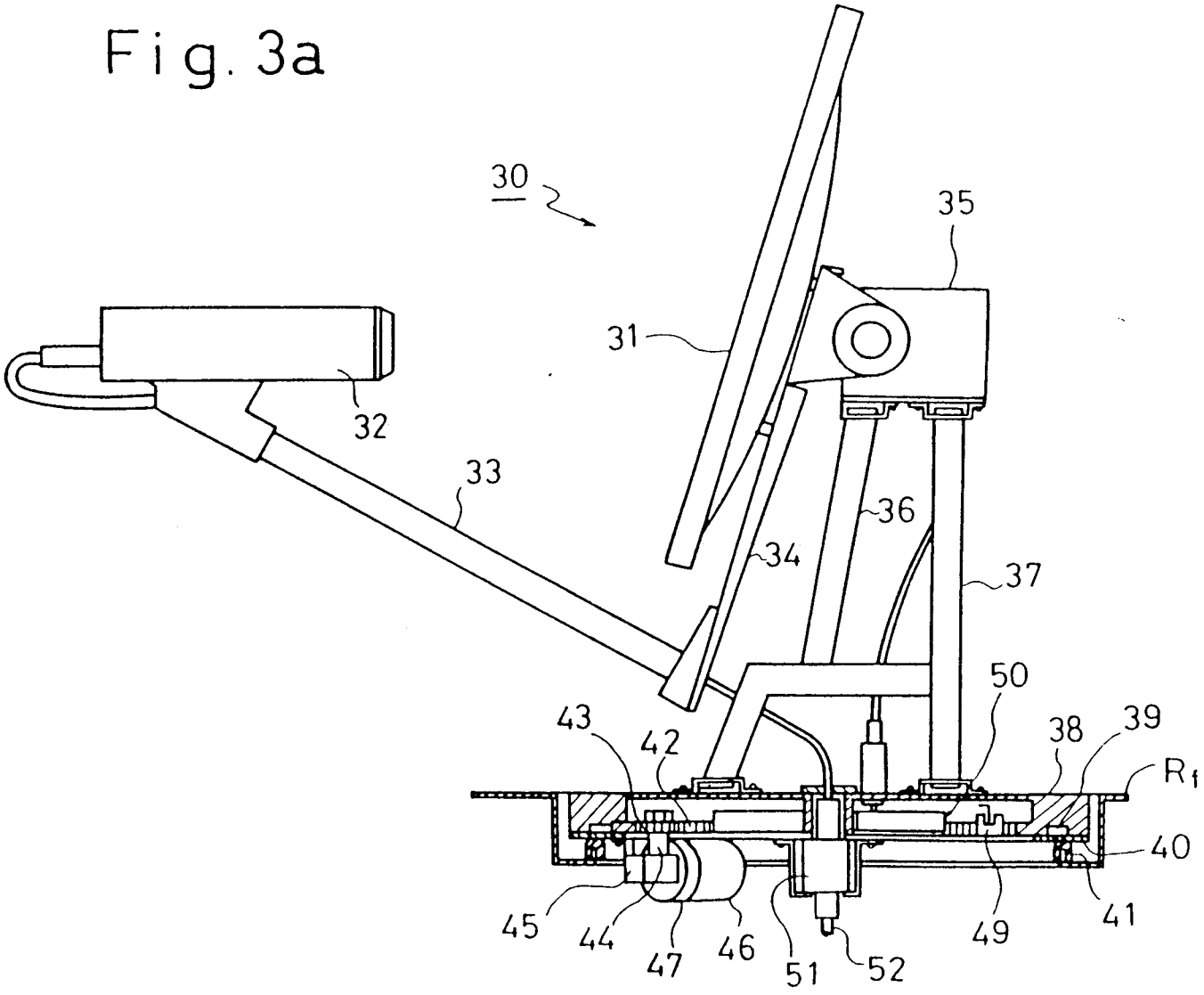
FIGS. 3*a* and 3*b* are an enlarged side elevation and an enlarged plan view, both partly in section, showing the structure of an antenna 30 shown in FIG. 1.
Figure 3B:
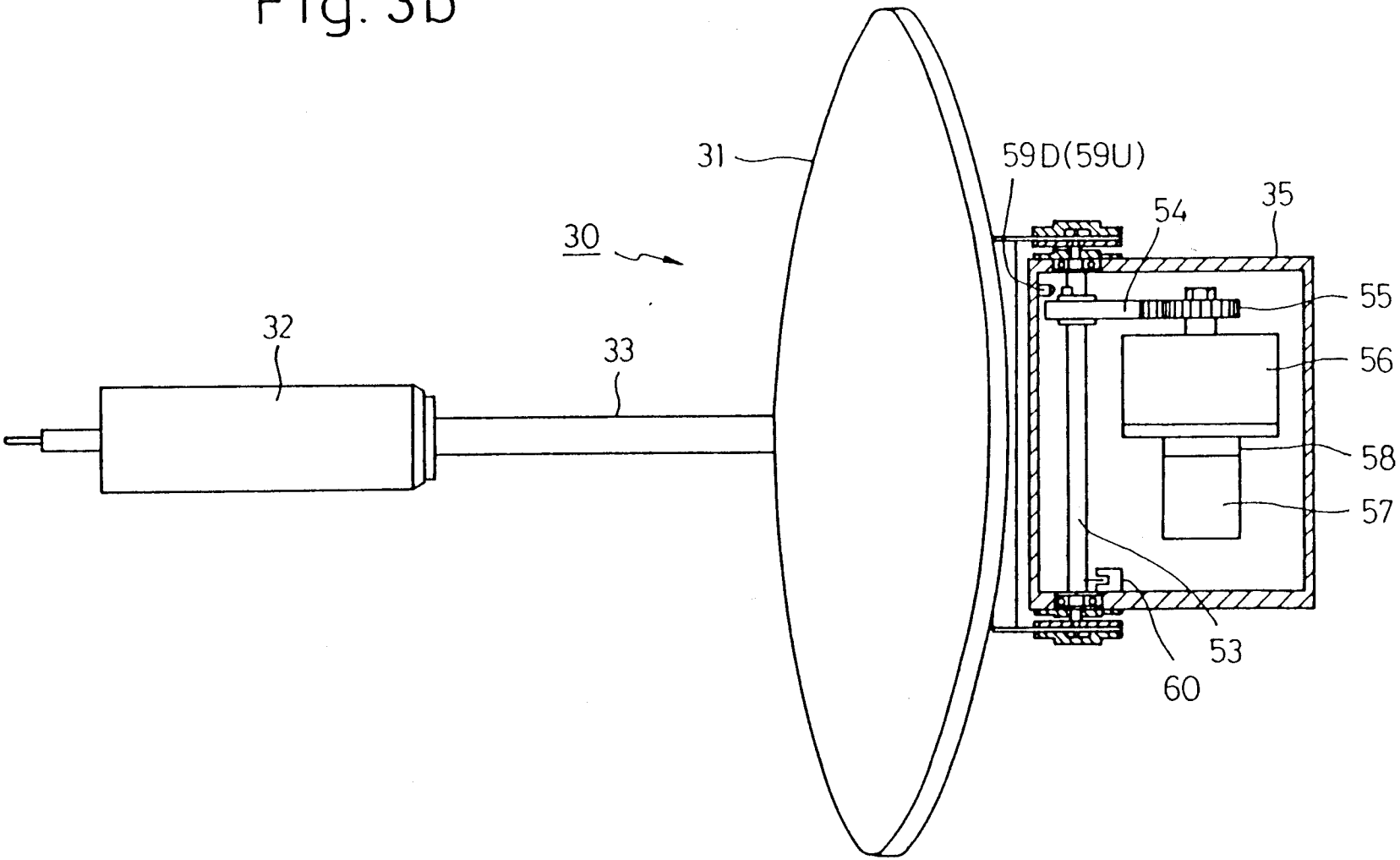

Referring to FIGS. 3*a* and 3*b*, the construction of the antenna 30 comprises a parabolic reflecting mirror 31 and antenna 30 comprises a parabolic reflecting mirror 31 and a primary radiator 32 which is integral with a BS converter. The combination of the mirror 31 and the radiator 32 forms a radiation lobe (hereafter referred to as a main lobe) having a half-angle of 2° at the involved frequency.

The primary radiator 32 which is integral with the BS converter (hereafter collectively referred to as BS converter) is secured to the parabolic reflecting mirror 31 by support arms 33 and 34, while the parabolic reflecting mirror 31 is pivotally mounted on a support box 35, which is fixedly mounted on a rotatable base 38 of the antenna by frames 36 and 37. The base 38 is rotatably mounted on a stationary base 40 by means of a bearing 39. The stationary base 40 is fixedly connected to a circular depression formed in the roof Rf of a vehicle CAR, with a weather strip 41 interposed between the roof Rf and the base 40.

The rotatable base 38 is formed with an annular internal teeth 42, which mesh with a gear 43. The gear 43 is fixedly mounted on a shaft 44 which is coupled through a gear box 45 to the rotary shaft of an azimuth drive motor 46. A rotary encoder 49 is coupled to the rotary shaft of the motor 46.

The motor 46 is fixedly mounted on the stationary base 40, and hence when it is energized for rotation in the forward direction, it turns the rotatable base 38 clockwise as viewed from the top (FIG. 3*b*), thus turning it to the right in the azimuth direction. When energized for rotation in the reverse direction, it turns the base 38 counter-clockwise, as viewed from the top (FIG. 3*b*), thus turning it to the left in the azimuth direction. In other words, the radiating lobe of the antenna 30 will be driven to the right and to the left, respectively, in response to the energization of the motor 46 for rotation in the forward direction and the reverse direction, respectively. The encoder 47 delivers a single pulse for each change in the attitude of the antenna 30 in the azimuth direction by 0.5°. A photo-interrupter 49 (hereafter referred to Az sensor) detects a home position of the antenna 30 in the azimuth direction. At the home position, a light intercepting filler mounted on the lower side of the base 38 moves into the path.

A cable 48 is connected to electrical components within the support box 35 and is connected to a stationary cable, not shown, through a disc-shaped slip ring unit 50.

An electrical cable connected to the output of the BS converter 32 is coupled through a cylindrical rotary joint 51 to a stationary cable 52.

FIG. 3*b* is a top view as the antenna is viewed from the top of FIG. 3*a*. The internal construction of the support box 35 will now be described with reference to FIG. 3*b*.

A rotary shaft 53 is fixedly connected to the parabolic reflecting mirror 31, and fixedly carries a sector gear 54, which meshes with a gear 55 fixedly mounted on the output shaft of a gear box 56. The gear box 56 includes an input shaft which is engaged by the rotary shaft of an elevation drive motor 57. A rotary encoder 58 is coupled to the rotary shaft of the motor 57.

The motor 57 is fixedly mounted in the support box 35, so that when it is energized for rotation in the forward direction, it rotates the parabolic reflecting mirror 31 and the BS converter 32 integrally in an upward direction, or clockwise as viewed in FIG. 3*a*, representing an upward elevational direction. When energized for rotation in the reverse direction, it rotates the mirror 31 and the converter 32 integrally downward or counter-clockwise as viewed in FIG. 3*a*, representing a downward elevational direction. In other words, the radiating lobe of the antenna 30 will be directed upward and downward, respectively, in response to the energization of the motor 57 for rotation in the forward direction and the reverse direction, respectively. The encoder 58 delivers a single pulse for each change in the attitude of the antenna 30 in the elevational direction by 0.5°. While shown as overlapped in the illustration of FIG. 3*b*, a limit switch 59U which is located behind the sheet of the drawing detects a limit on the elevation angle of the antenna 30 while another limit switch 59D visible in the drawing detects a limit on the depression angle of the antenna 30. A photo-interrupter 60 (hereafter referred to as antenna El sensor) detects a home position of the antenna 30 in the elevational direction. At the home position, a light intercepting filler mounted on the rotary shaft 53 intercept it.

In the present embodiment, when the Az sensor and El sensor 60 detect the home position, the main lobe of the antenna 30 will be aligned with the direct forward direction of the vehicle CAR, or the direction in which the vehicle CAR moves when it runs straightforward, and is parallel to the roof Rf.

Figure 2A:
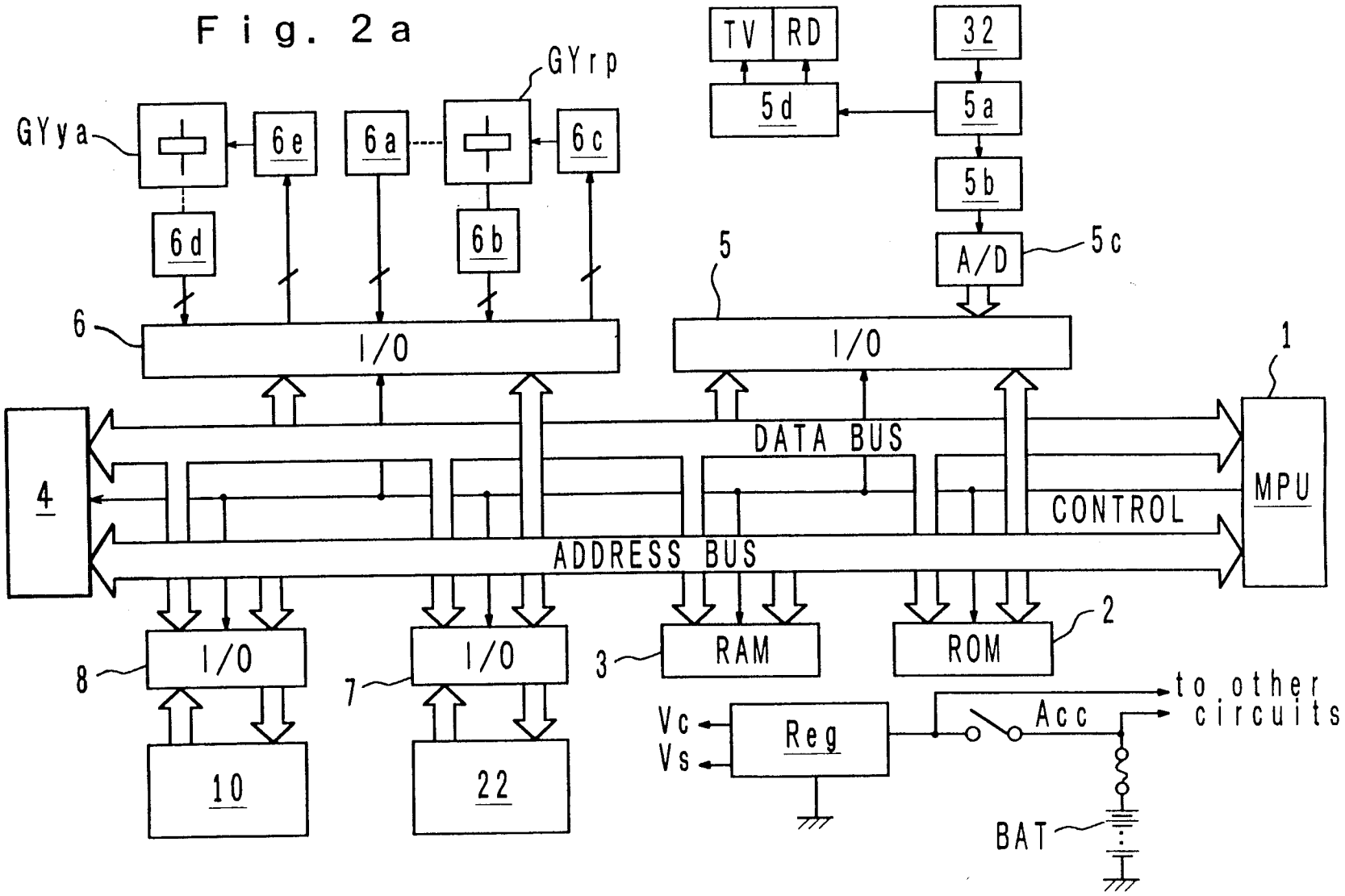
FIG. 2*a* is a block diagram of an attitude control system for antenna which is shown in FIG. 1.

FIG. 2*a* is a block diagram of a control system which performs an attitude control over the antenna 30. Specifically, the control system is constructed around a microcomputer (hereafter referred to as MPU) 1. MPU 1 has a bus, to which a read only memory (hereafter referred to as ROM) 2, read/write memory (hereafter referred to as RAM) 3, a timer 4 and input and output port assemblies (hereafter referred to as I/O) 5, 6, 7 and 8 are connected.

I/O 5 is connected to a reception level detector unit associated with the antenna 30. The unit comprises BS converter 32 which is contained in the antenna 30, a distributor 5*a*, a BS level detector 5*b* including an amplifier, a frequency converter and a detector, and an A/D converter 5*c*. The distributor 5*a* distributes an output from the converter 32 to the BS level detector 5*b* and a BS tuner 5*d*. The BS level detector 5*b* detects the level of a received signal, which is then applied to the converter 5*c*. In response to a command from MPU 1, the converter 5*c* performs a digital conversion of a received signal level from the BS level detector 5*b* for transfer to MPU 1. The tuner 5*d* is connected to a television receiver TV and a radio receiver RD which are used for receiving a satellite broadcasting.

A vehicle attitude detector unit is connected to I/O 6. This unit comprises a pitching/rolling angle detecting free gyro (GYrp), a yawing angle detecting gyro (GYya), a pitch angle detector 6*a*, a roll angle detector 6*b*, a yaw angle detector 6*d* and gyro drivers 6*c*, 6*e*. Gyro GYrp has a freedom of movement about a pitch axis and a roll axis. The pitch angle detector 6*a* detects an angle of rotation (digital data) around the pitch axis, and the roll angle detector 6*b* detects an angle of rotation (digital data) about the roll axis. Gyro GYya has a freedom of movement about the yaw axis, and the yaw angle detector 6*d* detects an angle of rotation (digital data) about the yaw axis. The gyro drivers 6*c* and 6*d* energize the rotor of corresponding gyro GYrp or GYya for rotation.

Figure 4:
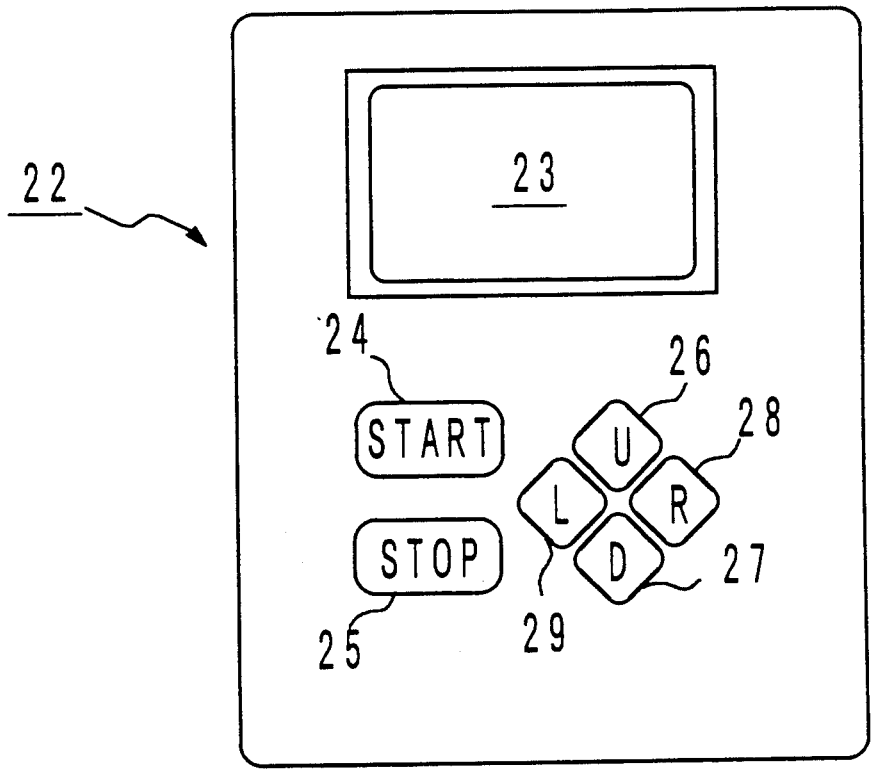
FIG. 4 is a plan view of an operating board 22 shown in FIG. 2.

An operating board 22 is connected to I/O 7. The board 22 is disposed in a console board of the vehicle CAR, the appearance of which is shown in FIG. 4. Referring to this Figure, the operating board 22 includes a small size CRT display 23 which displays data relating to the azimuth angle, the elevation angle or depression angle as well as the reception level and a variety of messages, a start (START) key 24 which commands an automatic attitude control over the antenna 30, a stop (STOP) key 25 which commands to cease the automatic attitude control over the antenna 30, and an up (U) key 26, a down (D) key 27, a right (R) key 28, and a left (L) key 29 which are used to perform a manual attitude control.

The operating board 22 internally includes a key encoder which reads key operations in response to a command from MPU 1, and a CRT driver which causes various messages to be displayed on the CRT display 23.

Figure 2B:
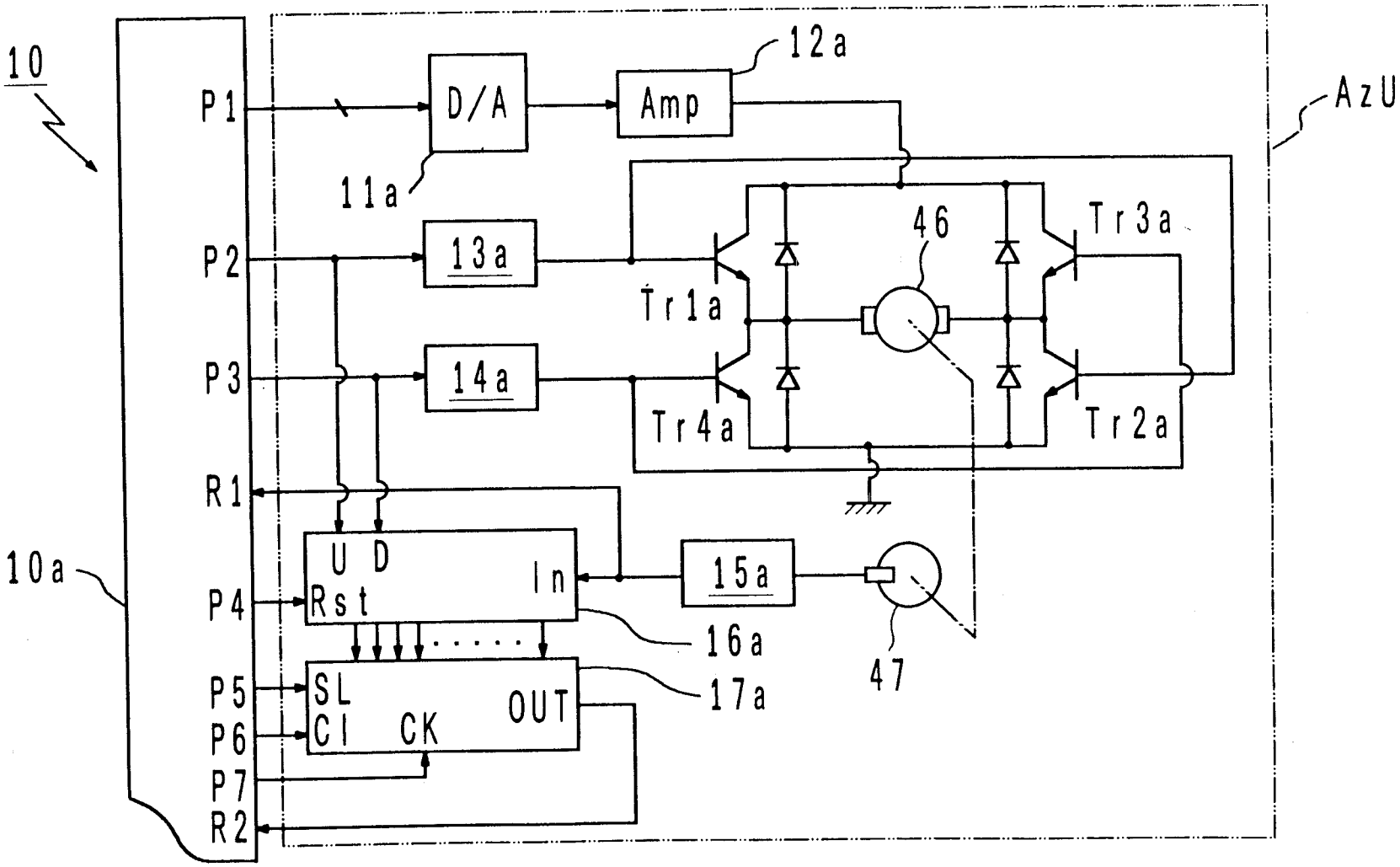
FIG. 2*b* is a block diagram showing the detail of one-half of a motor control unit 10 shown in FIG. 2*a;*
Figure 2C:
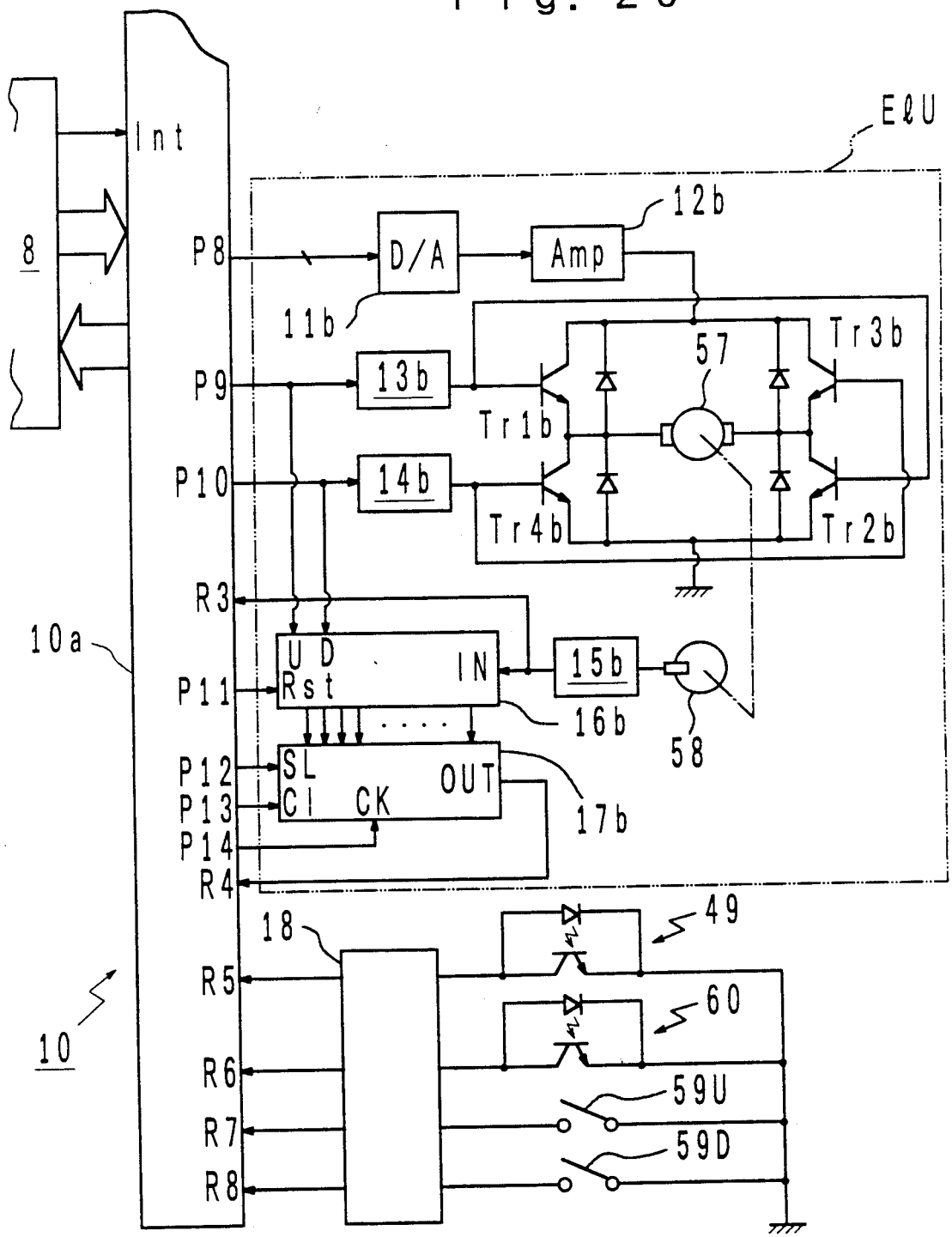
FIG. 2*c* is a block diagram showing the detail of a second half of the motor control unit 10, FIGS. 2*b* and 2*c* being joined together to show an entire motor control 10 in detail.

A motor control unit 10 including the azimuth drive motor 46 and the elevational drive motor 57 is connected to I/O 8. The unit 10 is shown in detail in FIG. 2*b*. Referring to FIGS. 2*b* and 2*c*, the unit 10 includes a microprocessor (hereafter referred to as CPU) 10*a*, an azimuth unit AzU, an elevation unit ElU, and an input buffer 18.

The azimuth unit AzU comprises a D/A converter 11*a*, a power amplifier 12*a*, base drivers 13*a* and 14*a*, a waveform shaper 15*a*, an up/down counter 16*a*, a parallel-out and serial-in shift register (hereafter referred to as PS register) 17*a*, the azimuth drive motor 46, the rotary encoder 47 and power transistors Tr1*a*, Tr2*a*, Tr3*a* and Tr4*a*.

The elevation unit ElU comprises a D/A converter 11*b*, a power amplifier 12*b*, base drivers 13*b* and 14*b*, a waveform shaper 15*b*, an up/down counter 16*b*, a PS register 17*b*, the elevation drive motor 57, the rotary encoder 58 and power transistors Tr1*b*, Tr2*b*, Tr3*b* and Tr4*b*.

Connected to the input buffer 18 are Az sensor 49, El sensor 60 and limit switches 59U and 59D mentioned above.

In response to commands from MPU 1, CPU 10*a* controls the energization of the motors 46 and 57 for rotation in the forward or reverse direction at a specified speed, and reads azimuth angle data and elevation angle data as well as the status of the limit switches 59U and 59D for transfer to MPU 1.

Except for minor differences in the dimensions of components used, the azimuth unit AzU and the elevation unit ElU are similar in construction, and hence only the azimuth unit AzU will be described here.

Voltage data corresponding to the speed at which the motor 46 is to be energized in accordance with a command from MPU 1 and which is delivered from the output port P1 of CPU 10*a* is applied to the D/A converter 11*a* of the azimuth unit AzU. The converter 11*a* delivers a corresponding voltage to be applied to the power amplifier 12*a*. The amplifier 12*a* converts an output voltage from the converter 11*a* into a drive voltage for the motor 46 and applies it to the collectors of power transistors Tr1*a* and Tr3*a*. The transistor Tr1*a* has its emitter connected to the collector of the transistor Tr4*a* while the transistor Tr3*a* has its emitter connected to the collector of the transistor Tr2*a*. The emitters of the both transistors Tr4*a* and Tr2*a* are connected to the ground. The bases of the transistors Tr1*a* and Tr2*a* are connected to the output terminal of the base driver 13*a* while the bases of the transistors Tr3*a* and Tr4*a* are connected to the output terminal of the base driver 14*a*.

The base driver 13*a* has its input terminal connected to the output port P2 of CPU 10*a* and the base driver 14*a* has its input terminal connected to the output port P3 of CPU 10*a*. When the motor 46 is to be energized for rotation in the forward direction, CPU 10*a* delivers an H (high) level at its output port P2 to cause the base driver 13*a* to turn the transistors Tr1*a* and Tr2*a* on. It also delivers an L (low) level at its output port P3 to cause the base driver 14*a* to turn the transistors Tr3*a* and Tr4*a* off. Conversely, when the motor 46 is to be energized for rotation in the reverse direction, L level output from output port P2 causes the base driver 13*a* to turn the transistors Tr1*a* and Tr2*a* off while H level output from the output port P3 causes the base driver 14*a* to turn the transistors Tr3*a* and Tr4*a* on. When the motor 46 is to be deenergized, an L level is delivered to both output ports P2 and P3, causing the base drivers 13*a* and 14*a* to turn all of the transistors Tr1*a* to Tr4*a* off.

The motor 46 is connected across the junction between the transistors Tr1*a* and Tr4*a* and the junction between the transistors Tr2*a* and Tr3*a*. Accordingly, when the transistors Tr1*a* and Tr2*a* are on while the transistors Tr3*a* and Tr4*a* are off, a circuit is established for energizing the motor for rotation in the forward direction including the output of the amplifier 12*a*, the transistor Tr1*a*, motor 46, transistor Tr2*a* and returning to the ground. The motor is energized with the voltage which is determined by the converter 11*a*. When the transistors Tr1*a* and Tr2*a* are off and transistors Tr3*a* and Tr4*a* are on, a circuit is established for energizing the motor for rotation in the reverse direction including the output of amplifier 12*a*, transistor Tr3*a*, motor 46, transistor Tr4*a* and returning to the ground. The motor will be energized with the voltage which is determined by the converter 11*a*.

An output from the rotary encoder 47 is shaped by the waveform shaper 15*a* before it is applied to the input port R1 of CPU 10*a* and to the input terminal In of the counter 16*a*. When an H level is applied to its U terminal and an L level is applied to its D terminal, the counter 16*a* counts up in response to the rising edge of a pulse applied to its input terminal In. Conversely, when an L level is applied to its U terminal and an H level is applied to its D terminal, it counts down in response to the rising edge of a pulse applied to its input terminal In. The counter 16*a* has a radix of 720 (10 bits) and when it counts up to 719, it is then reset to 0. When counting down from its count of 0, its count changes to 719.

The counter 16*a* has a reset input terminal Rst which is connected to the output port P4 of CPU 10*a*. The counter also has 10-bit parallel output terminals, which are connected to parallel input terminals of PS register 17*a*. The register 17*a* has a shift load input terminal SL, to which a shift load pulse is applied from the output port P5 of CPU 10*a*. The register also has a clock inhibit input terminal CI, to which a clock inhibit signal is applied from the output port P6 of CPU 10*a*. Finally, register 17*a* has a clock input terminal CK, to which a clock pulse is applied from the output port P7 of CPU 10*a*.

In response to the rising edge of the shift load pulse, the PS resistor 17*a* is operative to preset data which are applied to its parallel input terminals to the respective bit positions. When the clock inhibit signal turns to its H level, the register serially delivers preset data through its output terminal OUT to the serial input port R2 of CPU 10*a* in synchronism with the clock pulse.

Returning to FIG. 2*a*, the power supply for the system comprises an onboard battery BAT, which is connected through Acc switch (accessory mode switch) to a constant voltage circuit Reg, which feeds constant voltages of Vc and Vs. The constant voltage Vc is principally supplied as a power source for various parts of the control system while the constant voltage Vs is used as a power source for driving the motors and gyros.

Figure 5A:
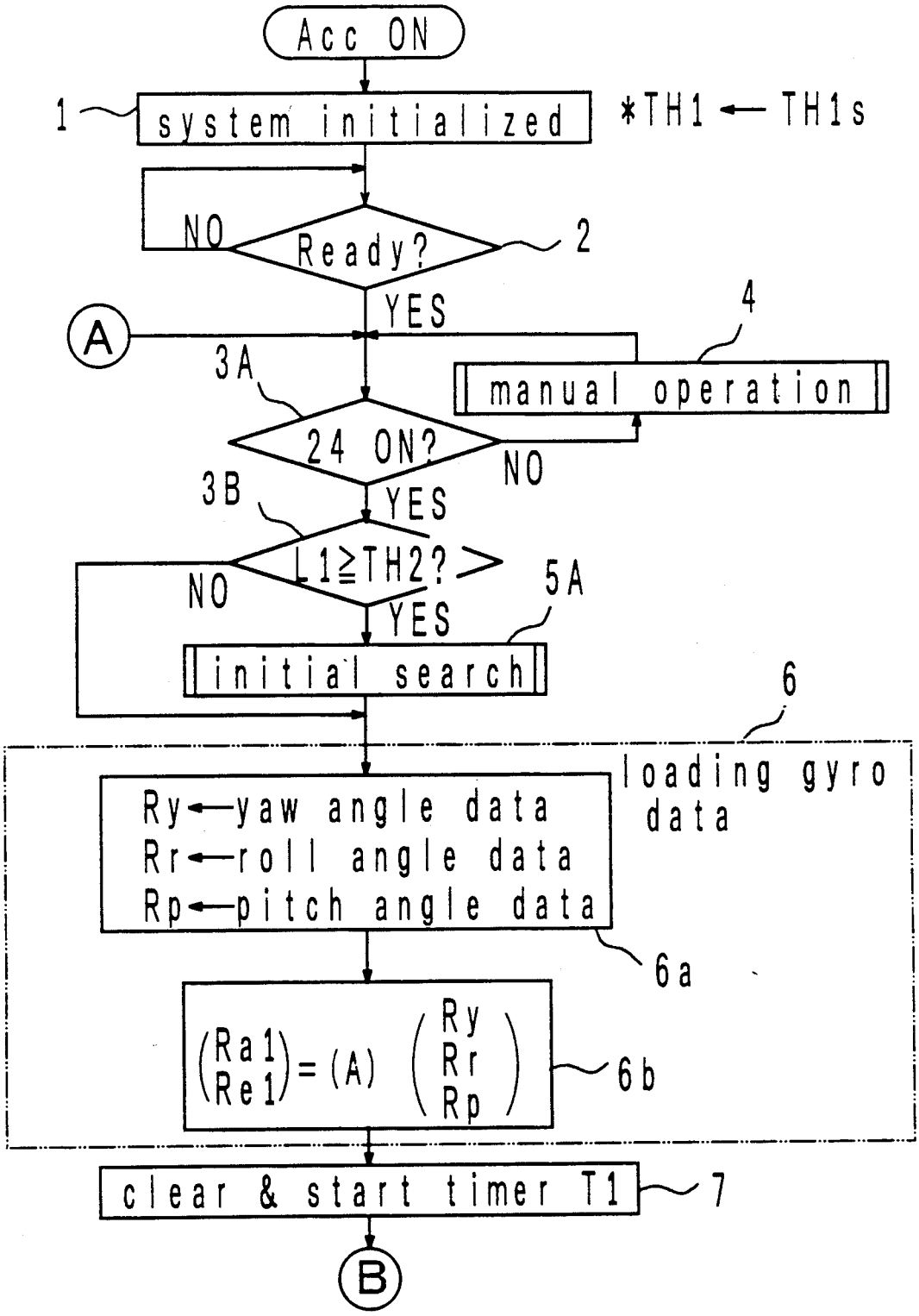
FIGS. 5*a*, 5*b*, 6, 7, 8*a*, 8*b*, 9*a* and 9*b* are flow charts showing the operation of a microcomputer 1 shown in FIG. 2*a;*
Figure 5B:
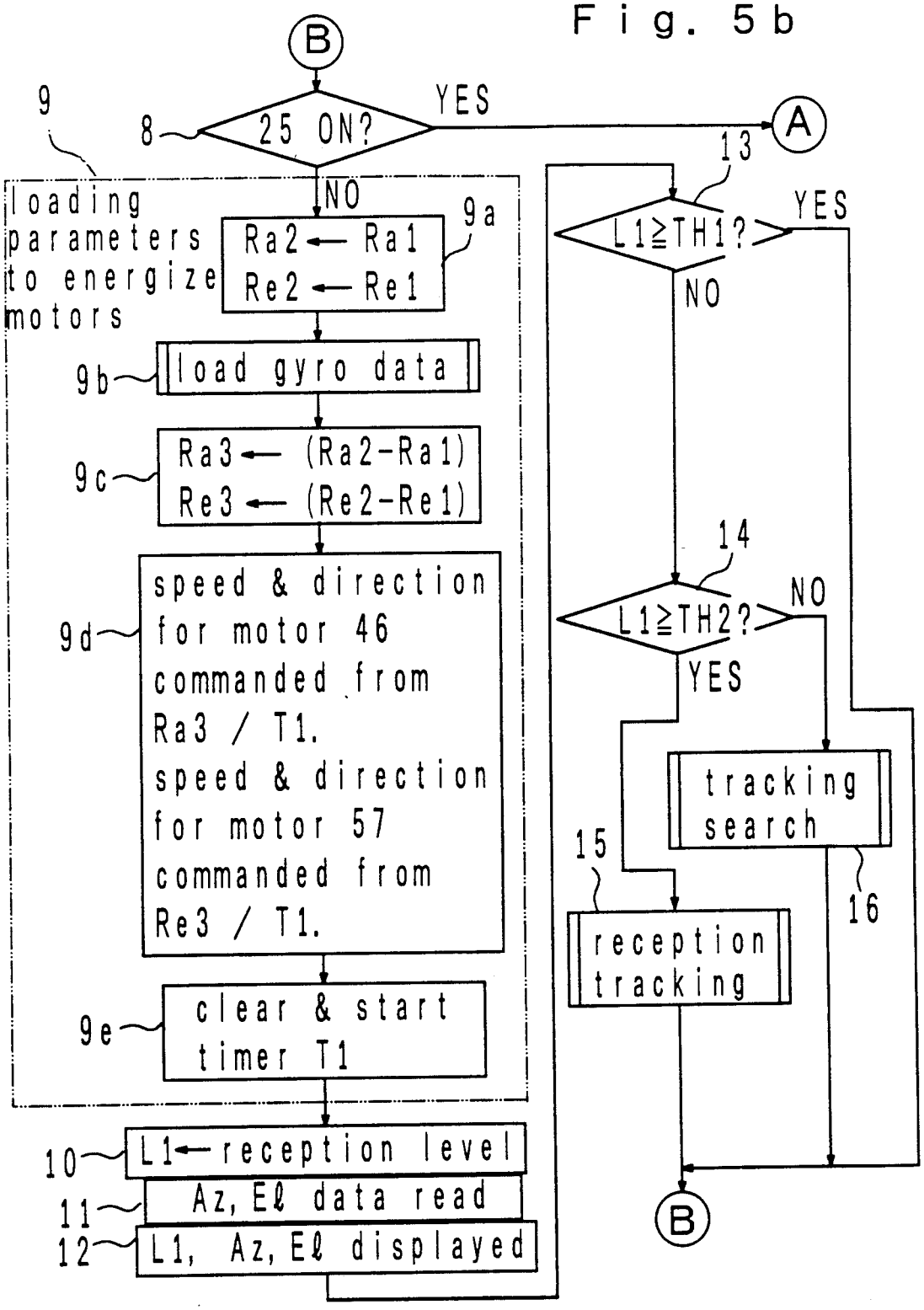
Figure 10:
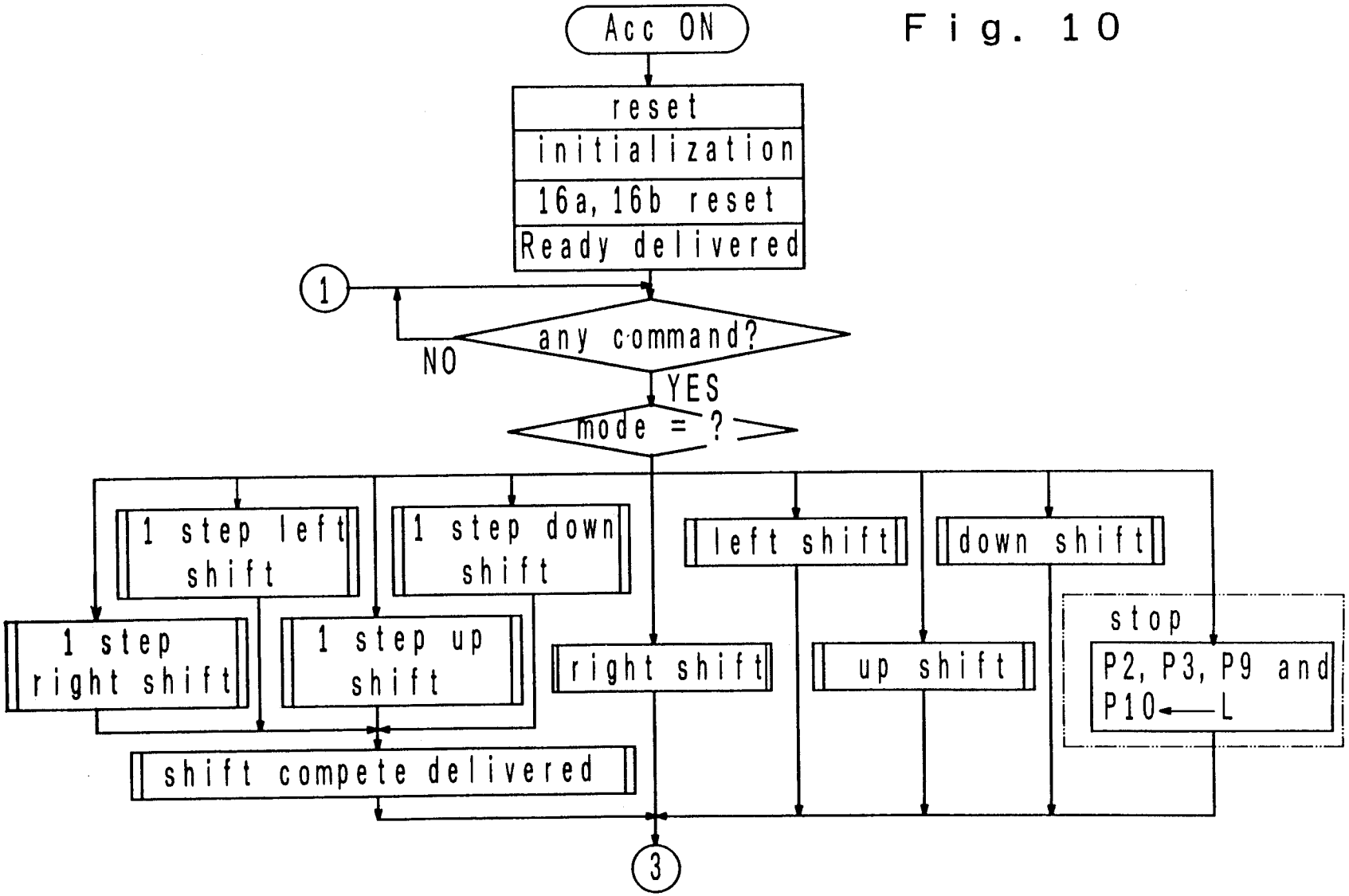
FIGS. 10, 11*a*, 11*b*, 11*c*, 11*d*, 11*e*, 11*f*, 11*g* and 11*h* are flow charts showing the operation of a microprocessor 10*a* shown in FIG. 2*b;*

The attitude control of the antenna which is performed using the described arrangement and utilizing a control operation by MPU 1 and CPU 10*a* will now be described. Flow charts shown in FIGS. 5*a* and 5*b* represent a main program of MPU 1 while flow charts shown in FIG. 10 represent main routines of CPU 10*a*. In the description to follow, an abbreviation "S--" represents a step number appearing in the respective flow charts, even though the denotation "S" is omitted in the individual flow charts.

Referring to FIG. 5*a*, when Acc switch is turned on and given voltages are fed to various parts, MPU 1 resets and initializes various input and output ports, internal registers, flags and RAM 3, and stores a standard value TH1s for a first reference into a register TH1 which stores the first reference at S1, and then enters a loop in which it waits for a Ready signal from CPU 10*a*.

Returning to FIG. 10, in CPU 10*a*, an initialization takes place after resetting input and output ports and internal registers. During the initialization, the antenna 30 is set to its home position as viewed in the azimuth and the elevation direction. Specifically, the motor 46 is energized for rotation in the forward direction to search for an attitude, as viewed in the azimuth direction, where Az sensor 49 is turned on. Subsequently, the motor 57 is energized for rotation in the forward direction, searching for an attitude, as viewed in the elevational direction, where El sensor 60 is turned on. When the attitude of the antenna 30 in the elevational direction reaches its limit during the search and the limit switch 59U is turned on the motor 57 is energized for rotation in the reverse direction. Then an attitude in the elevational direction is then searched for where El sensor 60 is turned on. When CPU 10*a* has completed establishing the home position for the attitude of the antenna as viewed in the azimuth and the elevational direction, it resets the counters 16*a* and 16*b*, and delivers Ready signal to MPU 1. Subsequently, 1 step right shift, 1 step left shift, 1 step up shift, 1 step down shift, right shift, left shift, up shift, down shift or stop is executed depending on a mode which is commanded by MPU 1. These operations will be described later.

Upon receiving Ready signal from CPU 10*a*, MPU 1 loops around manual operation at S4 until START key 24 is turned on.

Figure 6:
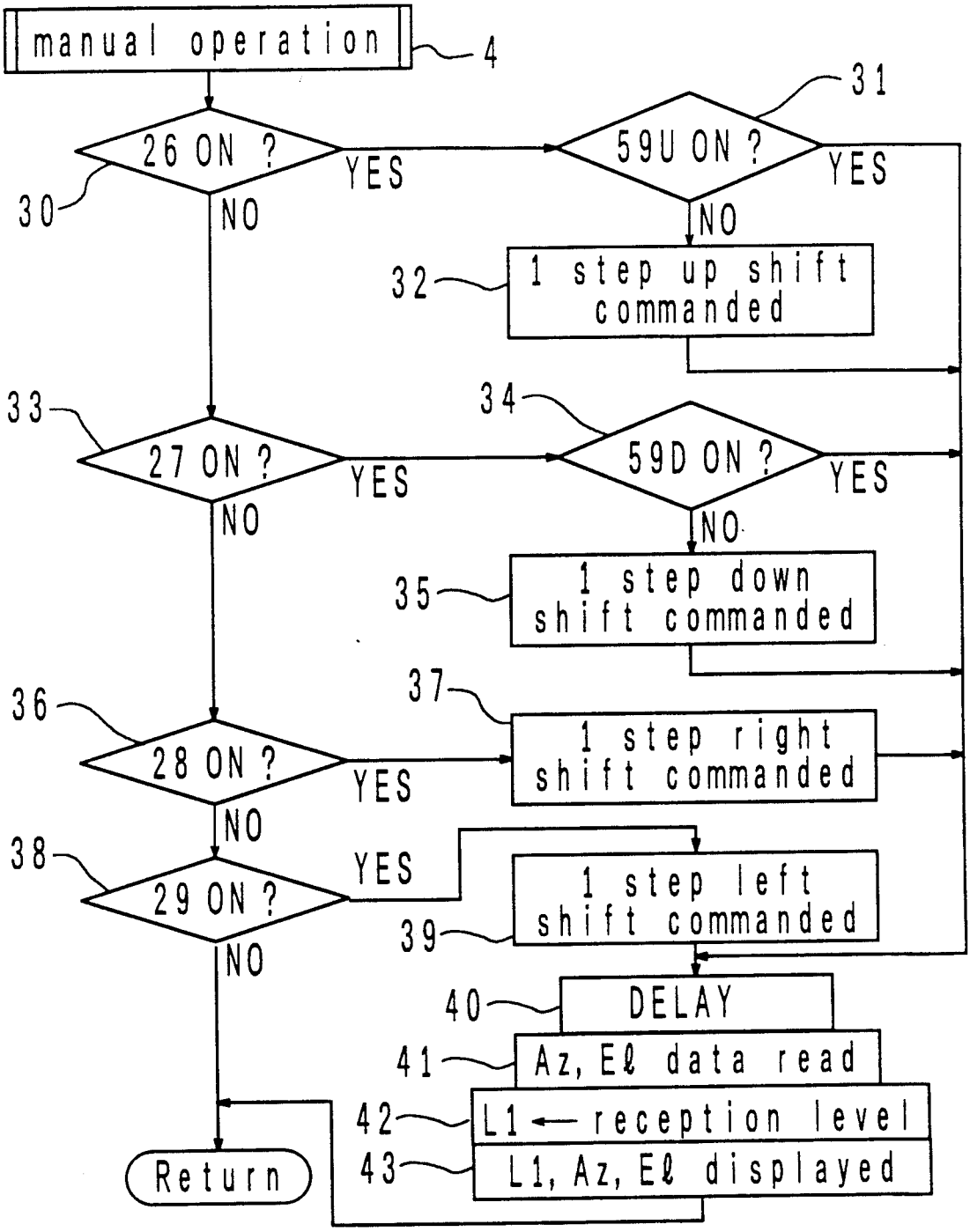

Referring to FIG. 6 which shows a flow chart for the manual operation, MPU 1 advances from S30 to S31 in response to an operation of U key 26, and then examines the status of the limit switch 59U. If the switch 59U is on, the antenna 30 is at its limit of elevational angle, and therefore cannot be driven further upward. Otherwise, CPU 10*a* is commanded to execute 1 step up shift at S32. If D key 27 has been operated, it advances from S33 to S34 where the status of the limit switch 59D is examined. If this switch 59D is on, the antenna 30 is at its limit of depression angle, and cannot be further driven downward. Otherwise, CPU 10*a* is commanded to execute 1 step down shift at S35.

When R key 28 is operated, MPU 1 advances from S36 to S37 where it commands CPU 10*a* to execute 1 step right shift. When L key 29 is operated, MPU 1 advances from S38 to S39 where it commands CPU 10*a* to execute 1 step left shift.

Figures 11A, 11B, 11C, 11D:
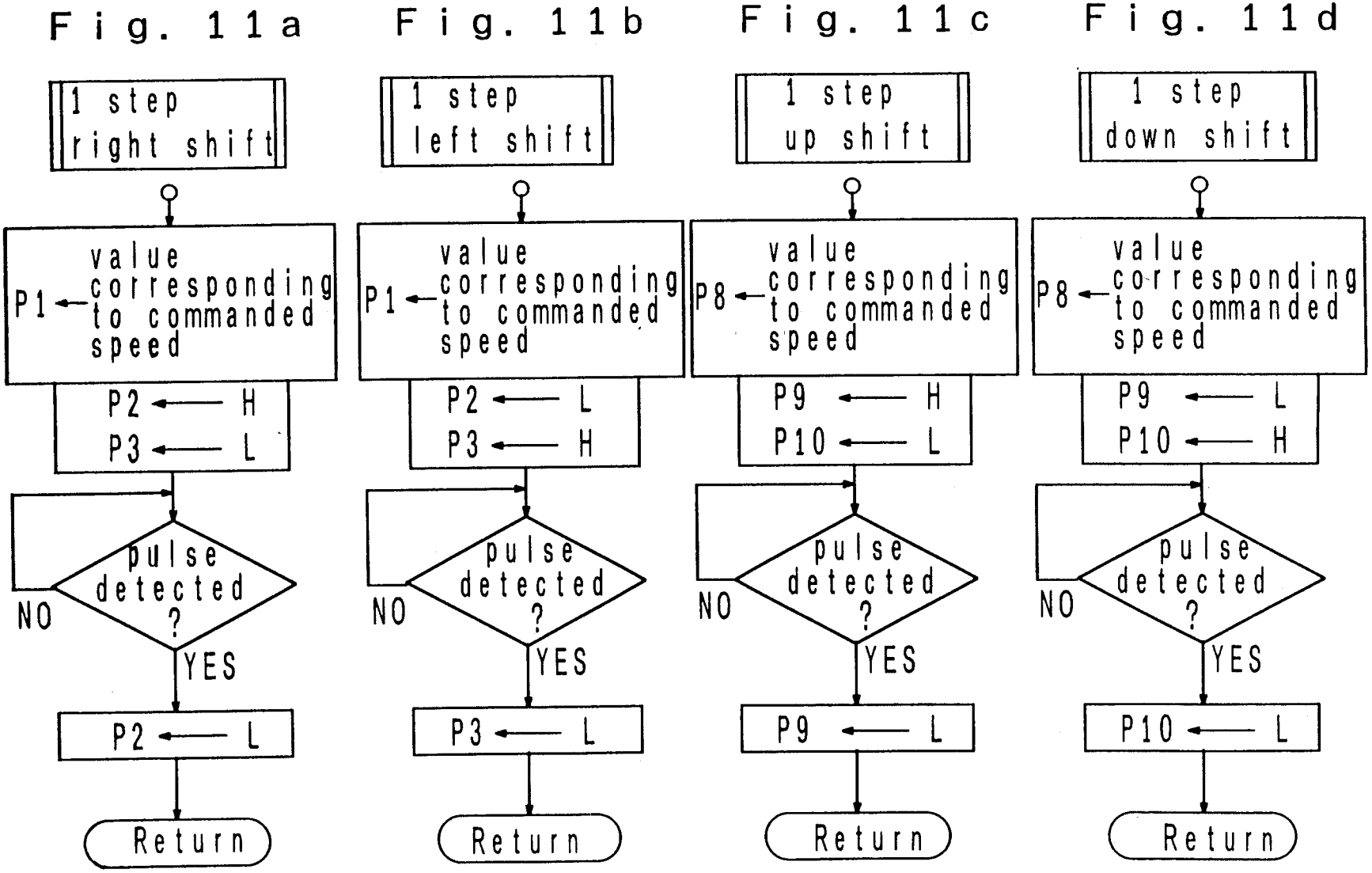

In response to 1 step drive command from MPU 1, CPU 10*a* executes 1 step right shift which is shown in FIG. 11*a*,1 step left shift which is shown in FIG. 11*b*, 1 step up shift which is shown in FIG. 11*c* and 1 step down shift which is shown in FIG. 11*d*.

Referring to FIG. 11*a* for the description of 1 step right shift operation, CPU 10*a* delivers voltage data which corresponds to a maximum speed of the motor 46 at its output port P1, which is then applied to T/A converter 11*a*. It also delivers an H level at its output port P2 and an L level at its output port P3, causing the base driver 13*a* to turn the transistors Tr1*a* and Tr2*a* on and causing the base driver 14*a* to turn the transistors Tr3*a* and Tr4*a* off. In this manner, the counter 16*a* is commanded to count up. Subsequently, as the motor 46 rotates in the forward direction, and an output pulse from the rotary encoder 47 is detected through the waveform shaper 15*a* at the input port R1, CPU 10*a* delivers an L level at its output port P2, causing the base driver 13*a* to turn the transistors Tr1*a* and Tr2*a* off, thus deenergizing the motor 46. Thus, during 1 step right shift, the attitude of the antenna 30 in the azimuth direction is shifted to the right by one step which is equal to 0.5°.

Similarly, in 1 step left shift operation shown in FIG. 11*b*, CPU 10*a* shifts the attitude of the antenna 30 in the azimuth direction 0.5° or one step to the left. In 1 step up shift operation shown in FIG. 11*c*, CPU 10*a* shifts the attitude of the antenna 30 in the elevational direction by 0.5° or one step upward. In 1 step down shift operation shown in FIG. 11*d*, CPU 10*a* shifts the attitude of the antenna 30 in the elevational direction 0.5° or one step downward.

Upon completion of either one of such 1 step shift operations, CPU 10*a* transfers a signal representing the completion of a shift operation and Az data representing the attitude in the azimuth direction as well as El data representing the attitude in the elevational direction to MPU 1.

Returning to FIG. 6, MPU 1 waits for the execution of 1 step right shift, 1 step left shift, 1 step up shift or 1 step down shift by CPU 10*a* at S40, and reads Az data and El data which have been transferred thereto at S41.

At S42, it reads the reception level, which is then stored in a register L1. At S43, Az data, El data and the reception level stored in the register L1 are displayed on CRT 23.

When the turn on of START key 24 is detected at S3A, MPU 1 examines if the reception level is equal to or greater than a given value TH2 at S3B. If not, it executes the initial search shown in FIG. 7 at S5.

Figure 7:
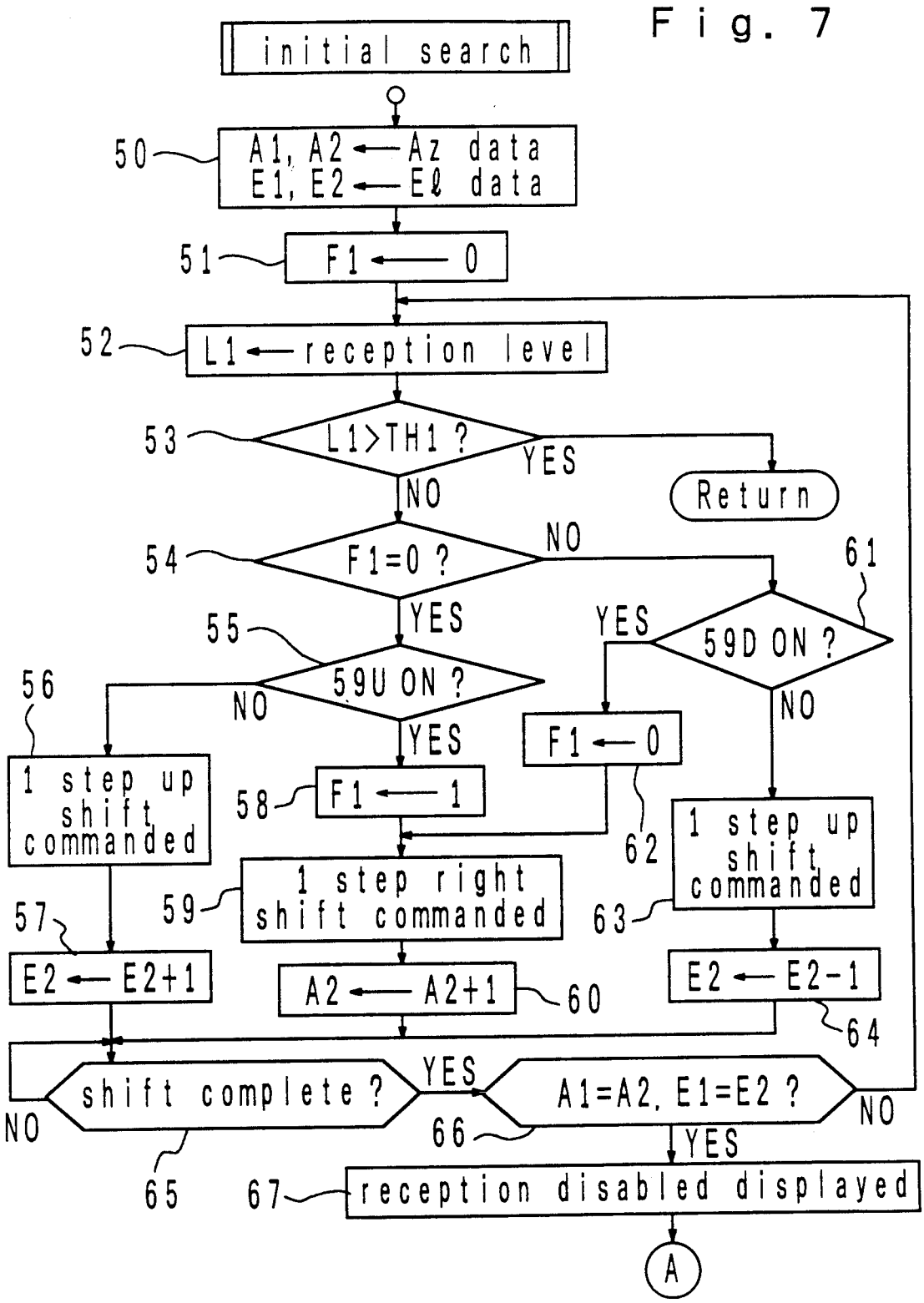
Figure 12:
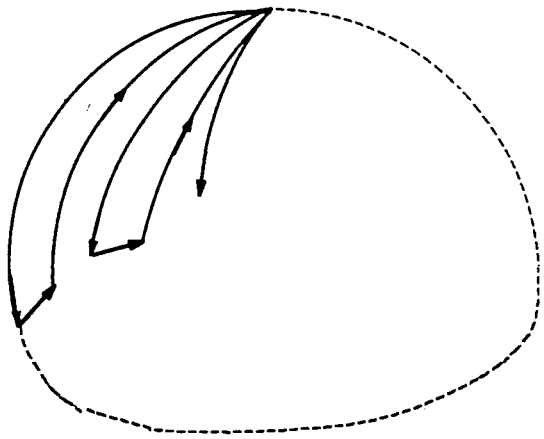
FIG. 12 is a diagram illustrating the concept of an initial search operation conducted by the microcomputer 1 shown in FIG. 2*a;*

Referring to FIG. 7 for the description of the initial search S5, a brief description of the concept of the initial search with reference to FIG. 12 will be in order. During this search, the attitude of the antenna 30 in the elevational direction is stepwise shifted upward from its lower limit position or the limit of depression angle to the upper limit position or the limit of the elevation angle while watching the reception level. When the upper limit position is reached, the attitude of the antenna 30 in the azimuth direction is stepwise shifted to the right, and then the stepwise downward shift is repeated from the upper limit to the lower limit position. When the lower limit position is reached, the attitude of the antenna 30 in the azimuth direction will be further shifted one step to the right. The described procedure is repeated over the entire perimeter until the reception level reaches an acceptable level. (In actuality, the stepwise shift takes place at an interval of 0.5° which will be much finer than the illustration in FIG. 12.)

More specifically referring to FIG. 7, Az data is stored in registers A1 and A2 and El data is stored in registers E1 and E2 at S50. Flag F1 is reset to zero at S51. Flag F1 is used to preset the direction of shift, either up or down, in the elevational direction.

Subsequently, the reception level is read and stored in register L1 at S52. If the prevailing reception level or a value stored in the register L1 is equal to or greater than the second reference TH2, MPU 1 immediately returns to the main program through S53, but if the reception level is below the second reference TH2, the operation proceeds to S54 and subsequent steps for altering the attitude of the antenna. Initially, when the flag F1 is reset, the operation proceeds from S54 to S55 to S56 where CPU 10*a* is commanded to execute the 1 step up shift, and the register E2 is incremented by one at S57 if the limit switch 59U is not on. Upon receiving a shift complete signal from CPU 10*a*, MPU 1 returns to S52 again, and repeats the above operation while watching the reception level. If the switch 59U is turned on before the reception level reaches the second reference TH2, the flag F1 is set to "1" at S58, and CPU 10*a* is commanded to execute the 1 step right shift at S59, and register A2 is incremented by one at S60 (except when the incremented value reaches 720, in which instance it is returned to "0").

After the flag F1 has been set to "1", the operation proceeds from S54 to S61 to S63 where CPU 10*a* is commanded to execute the 1 step down shift, and the register E2 is decremented by one at S64. The described procedure is repeated subsequently. If the switch 59D is turned on before the reception level reaches the second reference TH2, the flag F1 is reset to "0" at S62, and CPU 10*a* is commanded to execute the 1 step right shift at S59, and the register A2 is incremented by one at S60 (except when the incremented value reaches 720, in which instance the register is reset to "0").

If the reception level reaches the second reference value during the time the above procedure is repeated, the operation returns to the main program. However, if the attitude of the antenna 30 reaches a condition under which the initial search has been initiated, meaning that the value in the register A2 becomes equal to the value in the register A1 and the value in the register E2 is equal to the value in the register E1, the operation then proceeds from S66 to S67 where "reception disabled" is displayed on CRT 23, and then returns to S3 in the main program.

When an attitude of the antenna 30 is found during the initial search S5 where the reception level is equal to or above the first reference TH1, gyro data is loaded at S6 in FIG. 5*a*. Specifically, at S6*a*, yaw angle data from the yaw angle detector 6*d* is stored in register Ry, roll angle data from the roll angle detector 6*b* is stored in register Rr, and pitch angle data from the pitch angle detector 6*a* is stored in register Rp. Then, at S6*b*, a conversion matrix (A) is used to convert them into data as represented in the azimuth and the elevational direction of the antenna 30. (It is to be noted that higher terms are omitted from the illustration a S6*b* in the flow chart.) A conversion table stored in ROM 2 is used to execute the calculation required to perform this conversion. Converted gyro data representing the azimuth direction is stored in register Ra1 while converted gyro data representing the elevational direction is stored in register Re1. After gyro data has been loaded at S6, an internal timer T1 is cleared and then started at S7.

Referring to FIG. 5*b* which shows the detail of loading parameters which are used to energize the motors at S9, MPU 1 saves gyro data corresponding to the azimuth direction which is stored in register Ra1 in register Ra2, and saves gyro data corresponding to the elevational direction which is stored in register Re1 in register Re2, at S9*a*. Subsequently, gyro data are loaded at S9*b* in the same manner as mentioned in connection with S6 above. Yaw angle data (Ry), roll angle data (Rr) and pitch angle data (Rp) as well as gyro data corresponding to the azimuth and the elevational direction, which are detected during this step are obtained to be stored in registers Ra1 and Re1, respectively. At step S9*c*, a difference between the values stored in registers Ra2 and Ra1 is stored in register Ra3 while a difference between values stored in registers Re2 and Re1 is stored in register Re3. In other words, values stored in registers Ra3 and Re3 represent variances in gyro data since the previous gyro data loading operation. The timer T1 determines the length of time during which the gyro data loading operation has taken place. Accordingly, the value stored in register Ra3 divided by the count in the timer T1 indicates a rate of displacement in the azimuth direction, with its sign representing the direction, and the value stored in register Re3 divided by the count in the timer T1 indicates a rate of displacement in the elevational direction, again with its sign indicating the direction. Accordingly, at S9*d*, these values are used to calculate the speed with which and direction in which the motors 46 and 57 are to be energized. Such speeds and right/left shift or up/down shift are supplied as commands to CPU 10*a*. These calculations are performed utilizing a table which is stored in ROM 2.

Figures 11E, 11F, 11G, 11H:
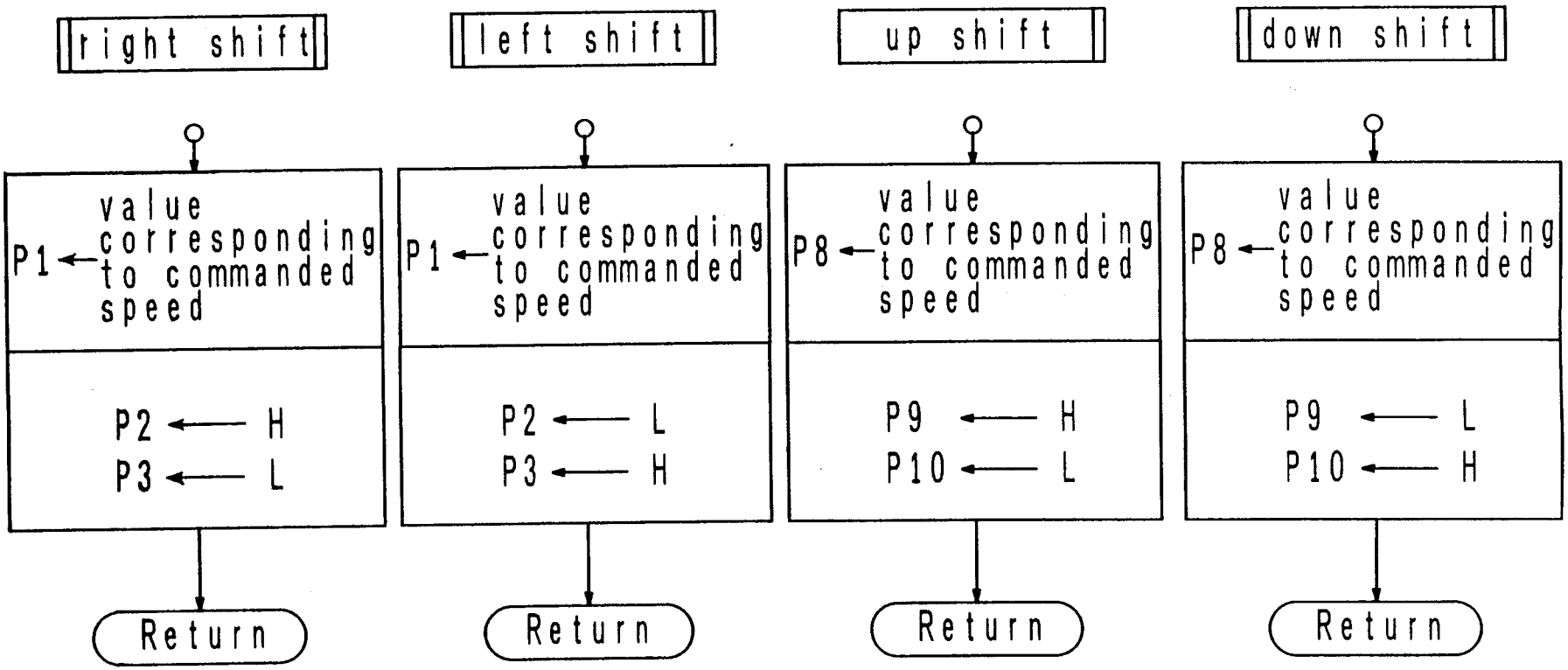

When MPU 1 provides a right shift command, CPU 10*a*delivers voltage data which corresponds to the indicated speed at its output port P1 and also delivers an H level at its output port P2, causing the base driver 13*a* to turn the transistors TR1*a* and Tr2*a* on, as shown in FIG. 11*e*. It also delivers an L level at its output port P3, causing the base driver 14*a* to turn the transistors Tr3*a* and Tr4*a* off. On the contrary, in response to a left shift command, CPU 10*a* delivers voltage data corresponding to an indicated speed at its output port P1 and also delivers an L level at its output port P2, causing the base driver 13*a* to turn the transistors Tr1*a* and Tr2*a* off, as shown in FIG. 11*f*. It also delivers an H level at its output port P3, causing the base driver 14*a* to turn the transistors Tr3*a* and Tr4*a* on. In response to an up shift command, CPU 10*a* delivers voltage data corresponding to an indicated speed at its output port P8 and also delivers an H level at its output port P9, causing the base driver 13*b* to turn the transistors Tr1*b* and Tr2*b* on. Also it delivers an L level at its output port P9, causing the base driver 14*b* to turn the transistors Tr3*b* and Tr4*b* off, as shown in FIG. 11*g*. In response to a down shift command, CPU 10*a* delivers voltage data corresponding to an indicated speed at its output port P8 and also delivers an L level at its output port P9, causing the base driver 13*b* to turn the transistors Tr1*b* and Tr2*b* off. It also delivers an H level at its output port P10, causing the base driver 14*b* to turn the transistors Tr3*b* and Tr4*b* on, as shown in FIG. 11*h*.

At S9*e* which follows, MPU 1 clears and starts the timer T1.

At S10 which follows, MPU 1 reads the reception level, and at S11, it reads Az data and El data which represent the attitude of the antenna 30. Subsequently, such data is displayed on CRT 23 at S12.

(0) At S13, the prevailing reception level or the value stored in the register L1 is compared against the first reference TH1, and as long as the value in the register L1 is equal to or greater than the first reference TH1, the operation loops around S8, S9, S10, S11, S12, S13 and S8—, executing an attitude control (0) of the antenna 30 on the basis of gyro data. In other words, as long as the reception level is equal to or greater than the first reference TH1, the attitude of the antenna 30 is corrected by an amount which corresponds to any change in gyro data. When STOP key 25 is turned on during such operation, this status is read at S8, and the operation returns to S3 (standby condition) in the main program shown in FIG. 5*a*.

While in the loop (S8 to S13) in which an attitude control over the antenna 30 is executed in accordance with any change in gyro data when the reception level is high, if the reception level or the value stored in the register L1 reduces below the first reference TH1, MPU 1 detects it at S13, and then the operation proceeds from S13 to S14 where the value in the register L1 is compared against the second reference TH2 or the lower limit of the reception level. If it is found at S14 that the value in the register L1 is equal to or greater than the lower limit reception level TH2, MPU 1 proceeds to S15 for executing the reception tracking operation.

Figure 8A:
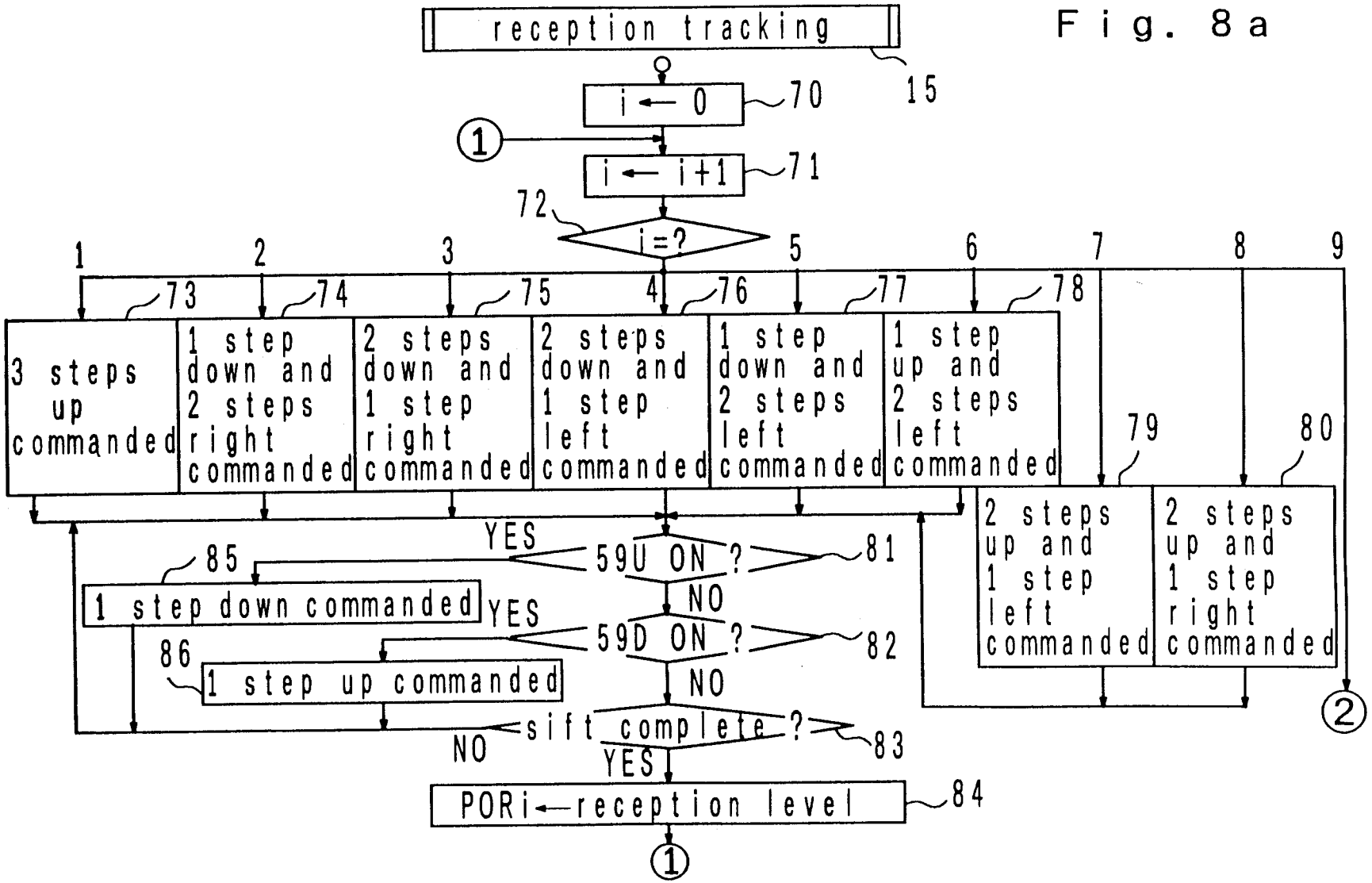
Figure 13:
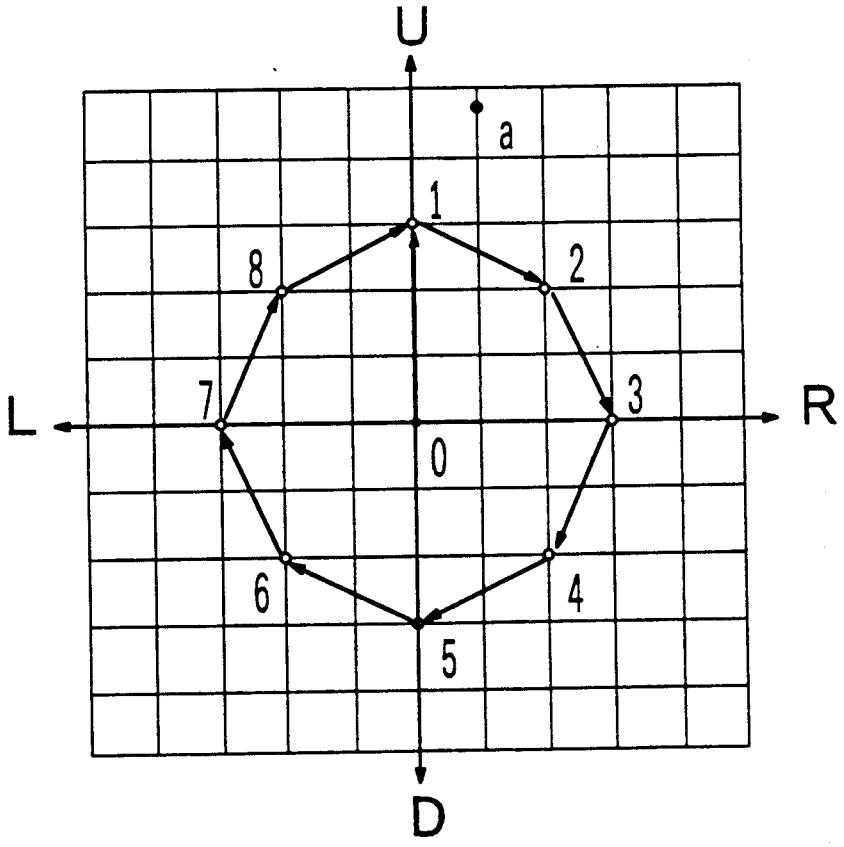
FIG. 13 is a diagram illustrating the concept of a reception tracking operation conducted by the microcomputer 1 shown in FIG. 2*a;*

(IA) Referring to FIGS. 8*a* and 8*b*, the reception operation will now be described. However, its concept will be initially described with reference to FIG. 13. FIG. 13 illustrates the concept by a developed view of scan positions into a plane as the antenna is conically scanned over a small range. The conical scan over the small range causes the main lobe of the antenna to rotate in the sequence of 1→2→3→4→5→6→7→8→1→. . . . The idea is that as long as the target or the source of radio wave is located on the center of rotation (0) of the antenna beam, the reception level remains substantially constant during the scan, but that if the target or the source of radio wave deviates from the center of rotation of the beam, a variation occurs in the reception level during the scan, producing a maximum. In FIG. 13, the grid is sectioned into steps (each 0.5°) in the elevational direction (U/D) and the azimuth direction (R/L). Points 1, 2, 3, 4, 5, 6, 7 and 8 represent point projections of the main beam (center) of the antenna 30. Point 0 represents the center of rotation of the antenna beam. The arrow indicates the direction in which the attitude of the antenna 30 is shifted. It is assumed that isotropic antenna (isotropic point source of radio wave) is located at point a. The reception tracking operation when the antenna 30 has its directivity oriented toward the point 0 will now be described with reference to FIGS. 8*a*, 8*b* and 13.

1) The antenna 30 is driven from the start point 0 to point 1 (S70 to S73), stores the reception level obtained at point 1 (S84), and then a two step shift takes place to the right in the azimuth direction, followed by one step shift downward in the elevational direction to bring the directivity to point 2 (S74), and the reception level obtained at point 2 is stored (S84).

2) Then one step shift to the right in the azimuth direction and two step shift downward in the elevational direction take place to bring the directivity to point 3 (S75), and the reception level at point 3 is stored (S84).

3) One step shift to the left in the azimuth direction and two step shift downward in the elevational direction then take place, to bring the directivity to point 4 (S76), and the reception level at point 4 is stored (S84).

4) Two step shift to the left in the azimuth direction and one step shift downward in the elevational direction then take place to bring the directivity to point 5 (S77), and the reception level at point 5 is stored (S84).

5) Two step shift to the left in the azimuth direction and one step shift upward in the elevational direction take place to bring the directivity to point 6 (S78), and the reception level at point 6 is stored (S84).

6) One step shift to the left in the azimuth direction and two step shift upward in the elevational direction take place to bring the directivity to point 7 (S79), and the reception level at point 7 is stored (S84).

7) One step shift to the right in the azimuth direction and two step shift upward in the elevational direction take place, to bring the directivity to point 8 (S80), and the reception level at point 8 is stored (S84).

This completes one conical scan, and the reception levels at all of the eight points are stored into registers POR1 to 8.

8) The reception level at points 1 to 8 are compared, and the maximum value (HR) and its associated point (HP) as well as a minimum value (LR) and its associated point (LP) are derived (S87 to 90H, L, 91).

9) At S92, it is examined if a difference HR-LR between the maximum value HR and the minimum value LR is less than a third reference TH3. At S93, it is examined if the maximum value HR is equal to or greater than the second reference. If the both examinations are found successful, the first reference TH1 (the content of register TH1) is updated to the detected maximum value HR multiplied by 0.9 at S94, and the attitude of the antenna 30 is adjusted to bring the center of rotation of the antenna beam into coincidence with the point HP associated with the maximum value HR (S95).

If it is found at S92 that the difference HR-LR is equal to or greater than the third reference TH3 or the maximum value HR is less than the second reference TH2, the first reference TH1 is not updated, and the attitude of the antenna 30 is adjusted to bring the center of rotation of the antenna beam into coincidence with the point HP associated with the maximum value HR (S95).

If the point a shown in FIG. 13 represents the true position of the source of radio wave, the magnitude of the reception level will be such that point 1>point 2>point 8>point 3>point 7>point 4>point 6>point 5, and accordingly the point where the maximum reception level is obtained will be point 1. Accordingly, the attitude of the antenna 30 is adjusted to bring the directivity of the antenna beam into alignment with the point 1.

As described above, in the reception tracking routine S15, a conical scan over a small range takes place in one cycle around the center (point 0) of the initial antenna beam in order to detect a point which provides the maximum reception level, and the attitude of the antenna 30 is adjusted to bring the center of the antenna beam thereat. Accordingly, when the source of radio wave moves relative to the antenna 30, an attitude control takes place in a manner such that the locus of the center (point 0) of the antenna beam travels with the source of radio wave, thus automatically tracking the source with the antenna 30.

When the single cycle conical scan and the attitude control (IA) have been finished, the reception level does not always remain at or above the first reference TH1. When the reception level is equal to or greater than the first reference TH1 as a result of the conical scan and the attitude control (IA), the attitude control (0) is executed. However, if the conical scan and the attitude control (IA) fail to bring the reception level to or above the first reference TH1, MPU 1 executes the subroutine S9 in which parameters used for the energization of the motors are loaded, and after passing through S10 to S13, it enters the reception tracking operation S15 (FIG. 8) or the single cycle conical scan and the attitude control (I). Since the loading of parameters which are used to energize the motors takes place at S9 between the proceeding single cycle conical scan and the succeeding single cycle conical scan, the center position (0 shown in FIG. 13) will shift in accordance with a change in the attitude of the vehicle as the conical scan is repeated. In other words, the antenna attitude automatically shifts in accordance with the change in the attitude of the vehicle even when the conical scan is repeated.

(IIIA) If the reception level decreases even though the antenna is oriented in an optimum direction (or HR-LR is less than TH3), the first reference TH1 is updated to the detected maximum value multiplied by 0.9 (and thus is sequentially reduced), so that a problem is avoided that a conical scan continues and cannot be stopped when the reception level is reduced as a result of the weather. As the weather recovers and the reception level rises, the first reference TH1 increases in a corresponding manner, thus precluding that a poor receiving condition continues in which the antenna attitude is maintained unchanged while the reception continues at a low level.

(IIA) Returning to FIG. 5*b*, when it is found at S14, that the reception level is less than the second reference TH2 which represents the lower limit, the operation proceeds to S16 where the tracking search routine is executed.

Figure 9A:
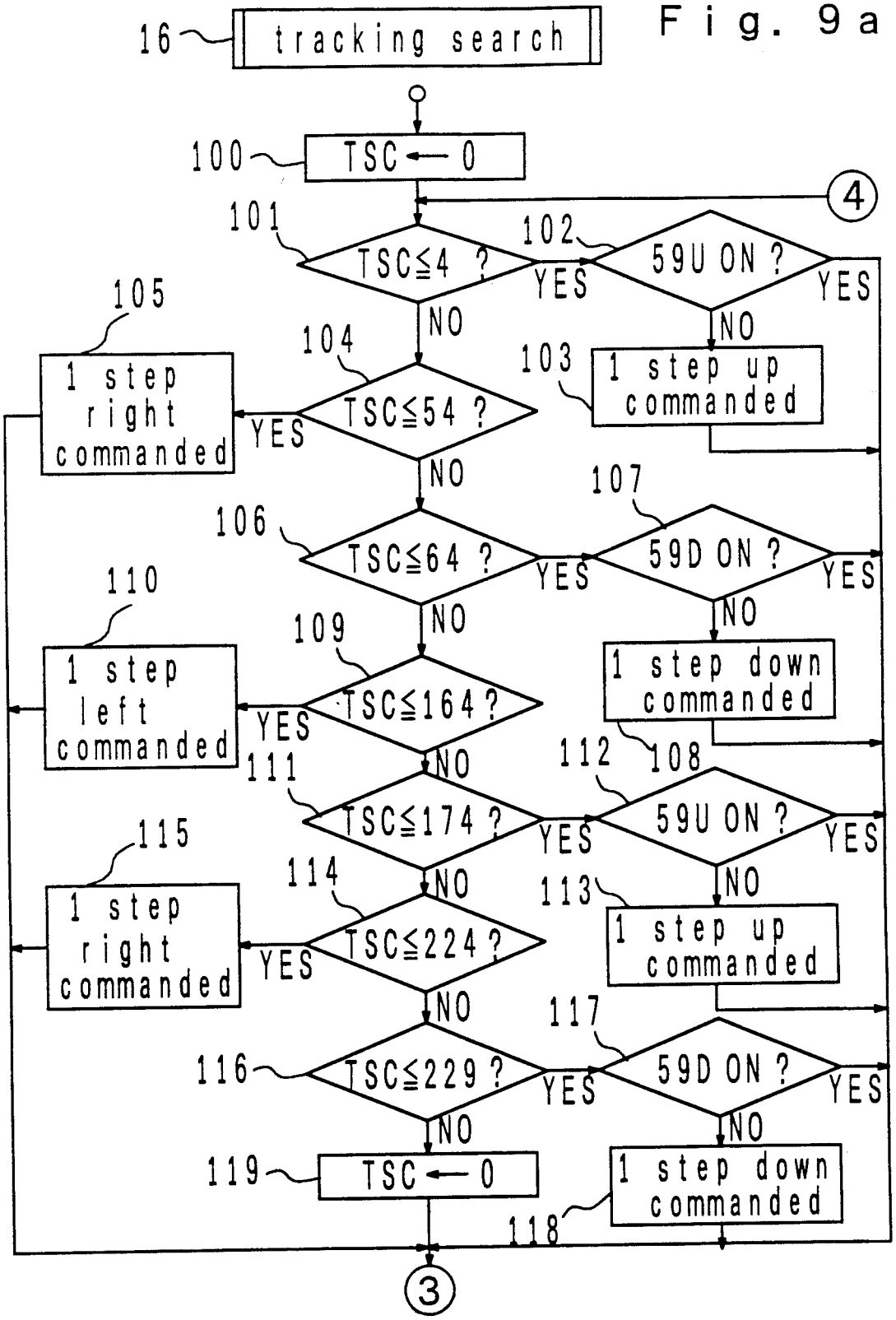
Figure 9B:
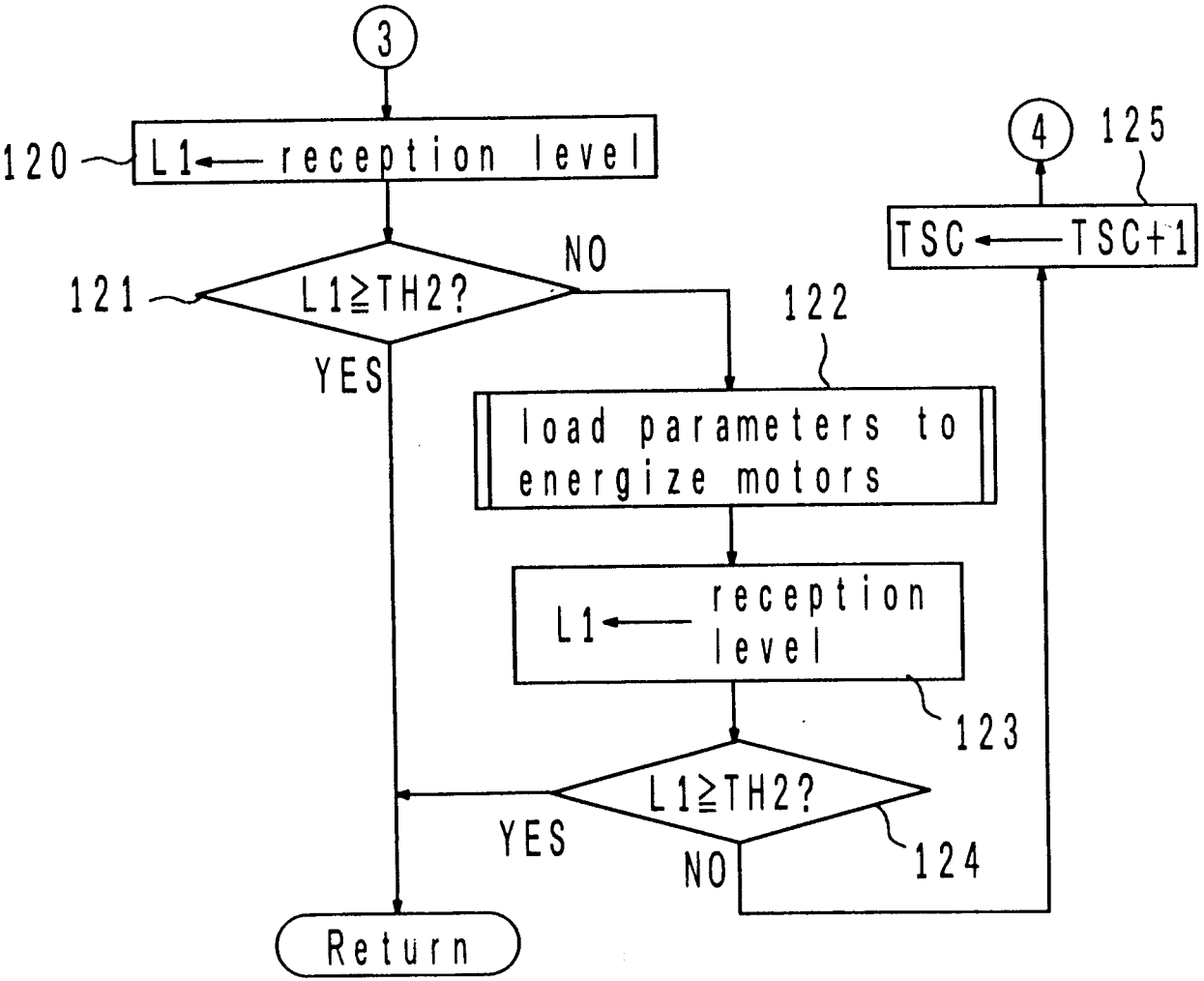
Figure 14:
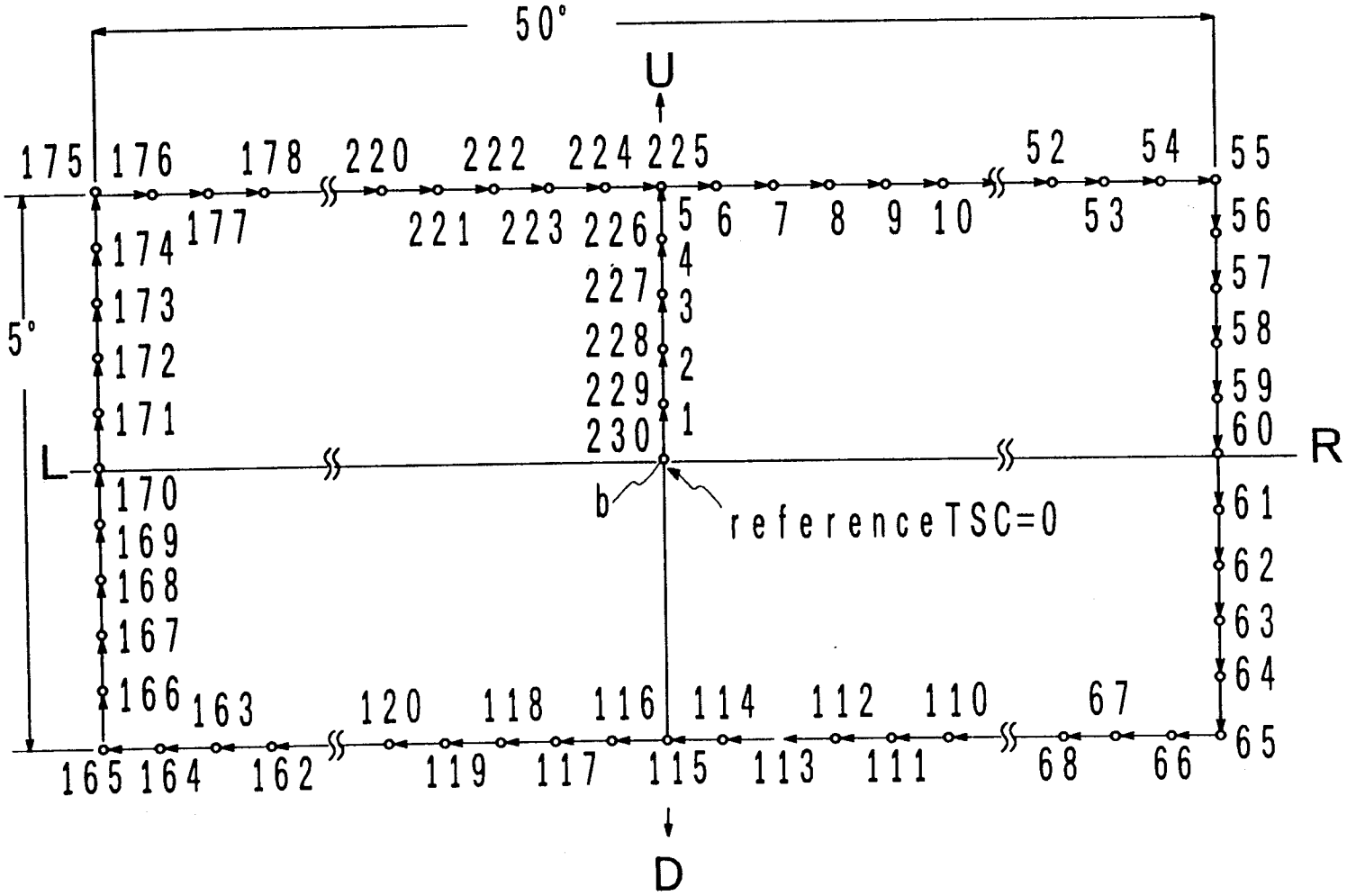
FIG. 14 is a diagram illustrating the concept of a tracking search operation conducted by the microcomputer 1 shown in FIG. 2*a;*

FIGS. 9*a* and 9*b* are flow charts of the tracking search routine, and FIG. 14 is a diagram illustrating the concept of the tracking search operation. The tracking search routine S16 will now be described with reference to these Figures. An initialization takes place at S100 and it is established that TSC=0 when the antenna 30 is directed to a point b shown in FIG. 14.

1) At S101, it is examined to see if the value of TSC is equal to 4 or less. As long as TSC is equal to or less than 4, the operation proceeds to S102 where the status of the switch 59U is examined. If it is not on, a command is supplied to CPU 10*a* to execute the 1 step up shift at S103. This corresponds to a scan from point 0 to point 5 shown in FIG. 14. If it is found at S101 that the value of TSC is equal to or greater than 5, the operation proceeds to S104.

2) At S104, it is examined to see if the value of TSC is equal to or less than 54. As long as the value of TSC is equal to or less than 54, the operation proceeds to S105 where a command is supplied to CPU 10*a* to execute the 1 step right shift. This corresponds to the scan from point 5 to point 55 shown in FIG. 14. If it is found at S104 that TSC is equal to or greater than 55, the operation proceeds to S106.

3) At S106, it is examined to see if the value of TSC is equal to or less than 64. As long as the value of TSC is less than 65, the operation proceeds to S107 where the status of the switch 59D is examined. If it is not on, a command is supplied to CPU 10*a* to execute the 1 step down shift at S108. This corresponds to the scan from point 55 to point 65 shown in FIG. 14. If it is found at S106 that the value of TSC is equal to or greater than 65, the operation proceeds to S109.

4) At S109, it is examined to see if the value of TSC is equal to or less than 164. As long as the value of TSC is equal to or less than 164, the operation proceeds to S110 where a command is supplied to CPU 10*a* to execute the 1 step left shift. This corresponds to a scan from point 65 to point 165 shown in FIG. 14. If it is found at S109 that the value of TSC is equal to or greater than 165, the operation proceeds to S111.

5) At S111, it is examined to see if the value of TSC is equal to or less than 174. As long as the value of TSC is equal to or less than 174, the operation proceeds to S112 where the status of the switch 59U is examined. If it is not on, a command is supplied to CPU 10*a* to execute the 1 step up shift at S113. This corresponds to the scan from point 165 to point 175 shown in FIG. 14. If it is found at S111 that the value of TSC is equal to or greater than 175, the operation proceeds to S114.

6) At S114, it is examined to see if the value of TSC is equal to or less than 224. As long as the value of TSC is equal to or less than 224, the operation proceeds to S115 where a command is supplied to CPU 10*a* to execute the 1 step right shift. This corresponds to the scan from point 175 to point 225 (or old point 5) shown in FIG. 14. If it is found at S114 that the value of TSC is equal to or greater than 25, the operation proceeds to S116.

7) If it is found at S116 that the value of TSC is equal to or less than 229, the operation proceeds to S117 where the status of the switch 59D is examined. If it is not on, a command is supplied to CPU 10*a* to execute the 1 step down shift at S118. This corresponds to the scan from point 225 (old point 5) to point 230 (old point 0) shown in FIG. 14.

8) If it is found at S116 that the value of TSC is equal to or greater than 230, and at the completion of the shift operations which are executed in the manner mentioned above, S120 is executed to read the reception level, and at S121, it is examined to see if the reception level is equal to or greater than the second reference TH2. If it is equal to or greater than the second reference TH2, the operation returns to the main program (FIG. 5*b*). If the reception level is less than the second reference TH2, the loading of parameters which are used to energize the motors is executed at S122 (which is equivalent to S9 shown in FIG. 5*b*). The reception level is read again at S123, and it is examined if it is equal to or greater than the second reference TH2 at S124. If the reception level is equal to or greater than the second reference TH2, the operation returns to the main program. However, if the reception level is less than the second reference TH2, TSC is incremented by one at S125, and the operation proceeds to S101.

It will be seen that the operation which covers S101 to S125 performs a search scan which starts at point b (0) and following points 1, 2, 3, ----- 230 (0) in this sequence as shown in FIG. 14, until the reception level becomes equal to or greater than the second reference TH2. At each point, it is examined if the reception level has reached the second reference TH2. If point 230 (b=0) is reached while the reception level remains below the second reference TH2, TSC is reset to 0 at S119 and the same search scan is repeated again starting from the point b.

During the search scan, as each point is reached, the loading of parameters which are used to energize the motors is executed at S122 to alter the attitude in accordance with any change in the values detected by gyros, so that as long as there is no change in the attitude of the vehicle, the position of the base point (b=0) does not change, but any change in the attitude of the vehicle automatically causes a shift in the base point, even though the range of the search scan with respect to the base point (FIG. 14) remains unchanged.

The described search scan is repeated as long as the radio wave is intercepted by any obstacle which is present, and any change in the attitude of the vehicle in the meantime cause the shift in the base point of the search scan. In this manner, when the radio wave is intercepted, the search scan is repeated along the locus shown in FIG. 14, with its base point (b=0 in FIG. 14) chosen at the location which the center of the antenna beam assumed immediately before that, until the radio wave can be received again. If there is a change in the attitude of the vehicle in the meantime, the base point is shifted accordingly.

The search scan (IIA) is also executed if the reception level reduces below the second reference TH2 because of a failure of the antenna tracking operations (0) and (IA) to follow a rapid change in the attitude of the vehicle.

It will be recognized that if a comparison level TH1 is fixed, against which the reception level is to be compared in order to determine the need to scan the antenna over a small range as in a conventional tracking system, an inconvenience is experienced when the weather changes. Thus, in response to a change in the maximum reception level which is caused by a change in the weather, the scan is continued without stop as long as a bad weather prevails if TH1 is chosen high while a high reception level cannot be obtained because of the absence of a scan being performed in the presence of a good weather if TH1 is chosen low.

By contrast, according to the first embodiment of the invention, a fluctuation in the reception level which is obtained during the scan over the small range causes a variable value to be chosen for TH1. In this manner, a lower value is automatically chosen for a bad weather (or low reception level), while a higher value is automatically chosen for a good weather (or high reception level), thus eliminating the inconvenience of the prior art. Such advantage is gained as an effective result of a control mode in which the small range scan is performed when it is effective, but ceases otherwise, thus avoiding a wasteful power dissipation and an associated abrasion of the mechanisms while simultaneously enabling the reception at as high a level as possible.

Second Embodiment

A hardware used in the second embodiment remains the same as that used in the first embodiment, but the microcomputer 1 operates in a different manner in the second embodiment from the first embodiment. Such difference will now be described.

Figure 15A:
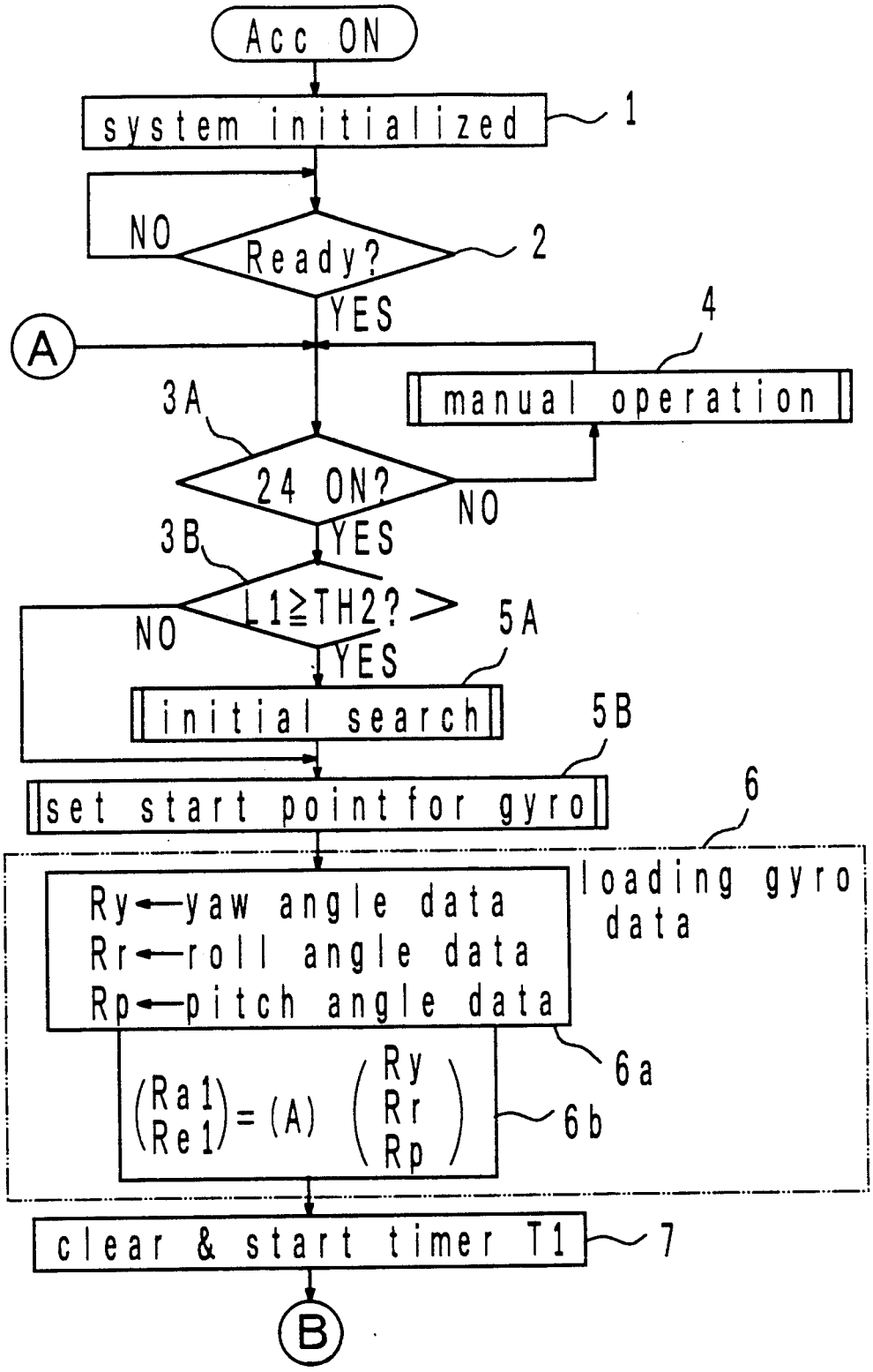

A main program for the microcomputer 1 in the second embodiment is shown in FIGS. 15*a* and 15*b*. As compared with the main program of the first embodiment shown in FIGS. 5*a* and 5*b*, the main program of the second embodiment differs therefrom in three respects; namely, "setting a start point for gyros" 5B takes place between the initial search 5A and loading of gyro data 6; "initialization of attitude calculation" 17 is executed when the reception level is equal to or greater than a given value TH1 which may or may not be equal to the first reference TH1; and the duration INC during which the reception level remains at or above a given value TH1 is initialized (clearing of register INC: 18) when the reception tracking routine 15 or the tracking search routine 16 is executed while the reception level is at or above the first reference TH1 which is fixed.

The routine 5B for setting a start point for gyro is executed when the initial search routine S5A searches for an attitude of the antenna 30 where the reception level is equal to or above the second reference TH2. In the present embodiment, the processing of attitude data is executed in a strap-down form in which an attitude of a moving vehicle is derived from a three-axis gyro. Accordingly, in the routine 5B, fixed initial values are given to Euler parameters, thus initializing a coordinate conversion matrix to a fixed one. In this manner, the start point of the attitude (0, 0, 0) represents the current attitude, and a variance from the start point is equal to 0.

Figure 17:
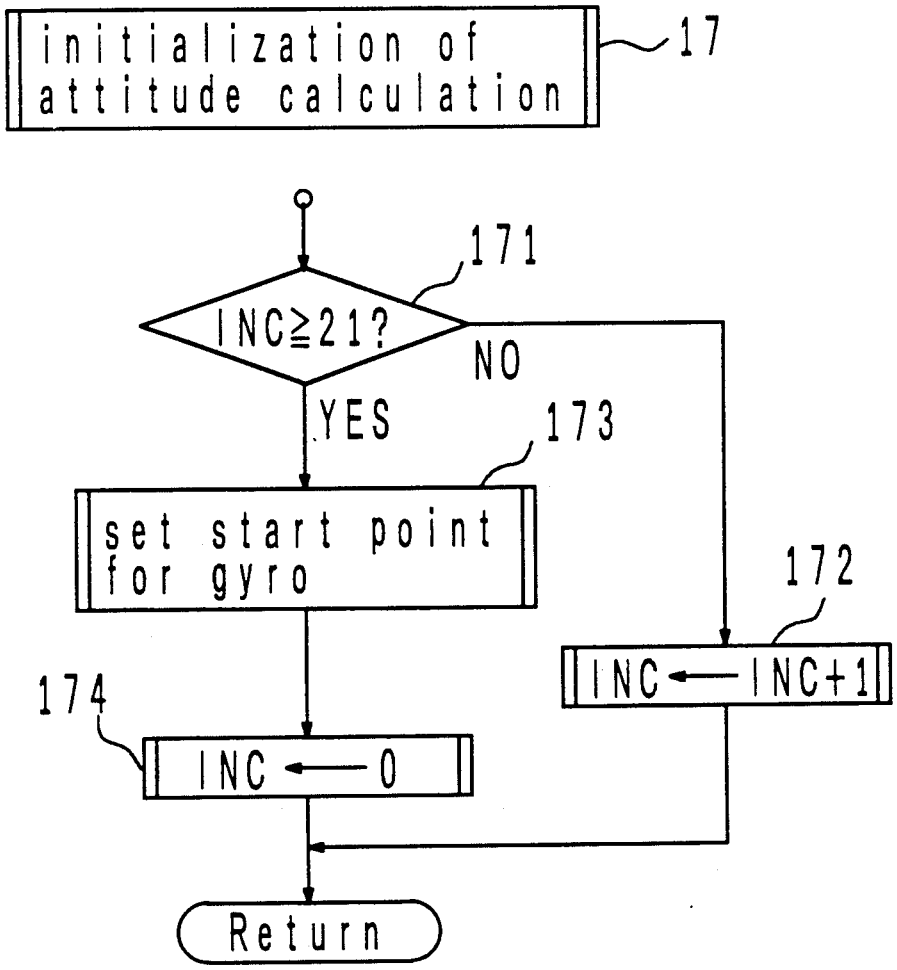
FIG. 17 is a flow chart of the initialization of attitude calculation routine 17 shown in FIG. 15*b*.

Referring to FIG. 17, the routine 17 for initializing the attitude calculation will be described in detail. When this routine is entered with the reception level at or above a given value TH1 (S13), MPU 1 refers to the content of a count register INC at S171, and if it is found to be equal to or less than 20, it increments the count register INC by one at S172, and the operation then proceeds to S8 shown in FIG. 15*b*. When INC becomes equal to 21, a start point for gyro is established at S173. Specifically, in a similar manner as the routine S5B, the start point for gyro data is preset as a prevailing attitude, and the variance from the start point is chosen to be 0. This clears any accumulated error in detecting the attitude of gyro. MPU 1 then resets the count register INC at S174, and then proceeds to S8 shown in FIG. 15*b*.

At S18 in FIG. 15*b*, INC is cleared if the reception level L1 is less than a given value TH1. Since the operation proceeds from S13 through the routine S17 (FIG. 17) for initializing the attitude calculation and then returns to S8 as long as the reception level L1 is at or above the first reference TH1, it follows that the execution of altering the antenna attitude only responsive to gyro data consecutively twenty-one times through the steps S9 to S13, meaning that a high reception level (at or above a given value TH1) continues in a stabilized manner, MPU 1 determines that the directivity of the antenna is accurately aimed at the source of radio wave, thus initializing gyro data. This clears any accumulated error in detecting the attitude which may be present in the gyro data. Accordingly, immediately after the clearing operation, there is no substantial accumulated error in gyro data, and the directivity of the antenna is substantially accurately aimed at the source of radio wave, so that the subsequent alteration of the antenna attitude (which takes place at S9*a* to S9*e*) responsive to a subsequent change in gyro data (or a change in the attitude from the start point) will be accurate, allowing the tracking operation to be continued over an increased interval responsive to gyro data.

Figure 8B:
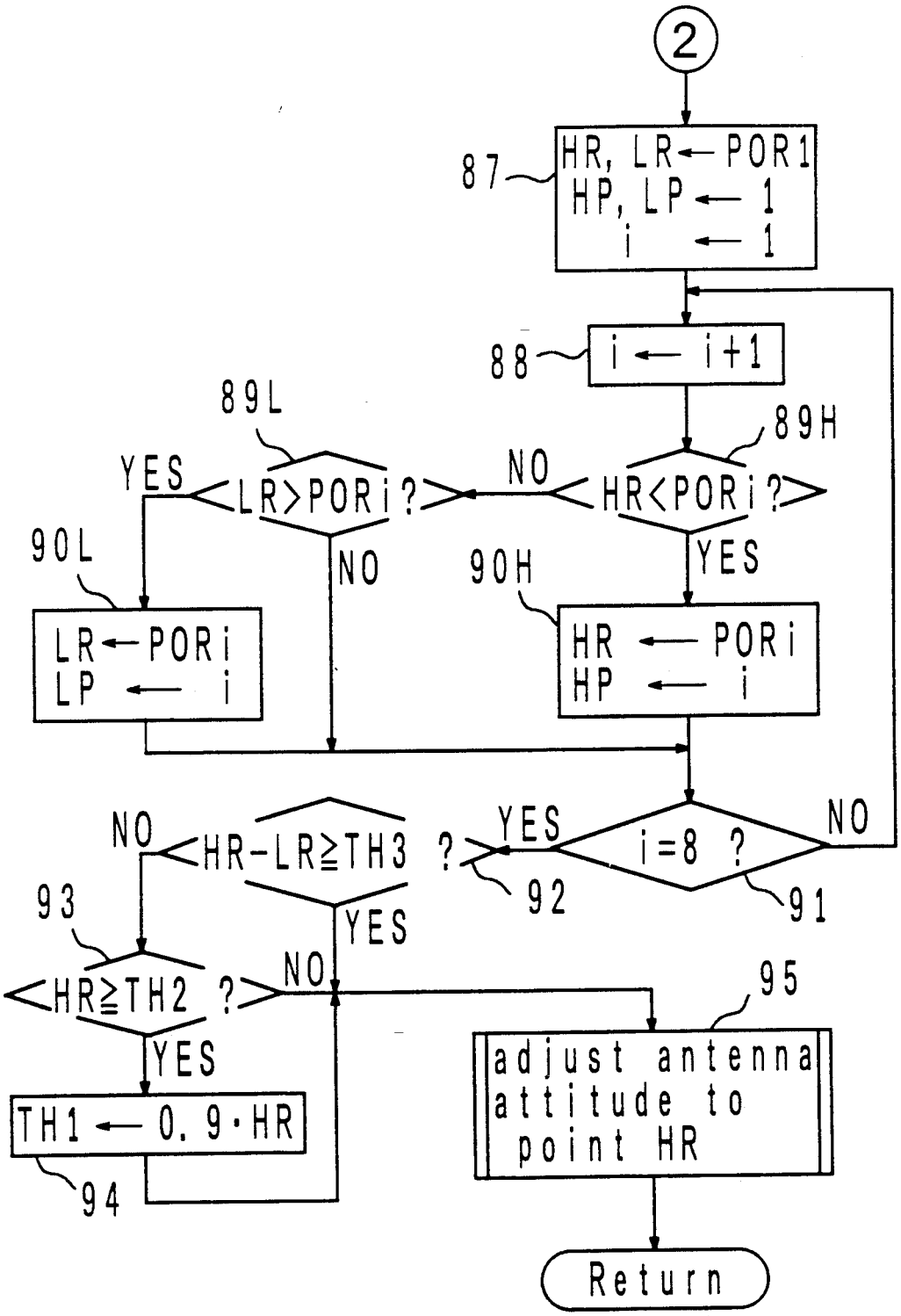
Figure 16:
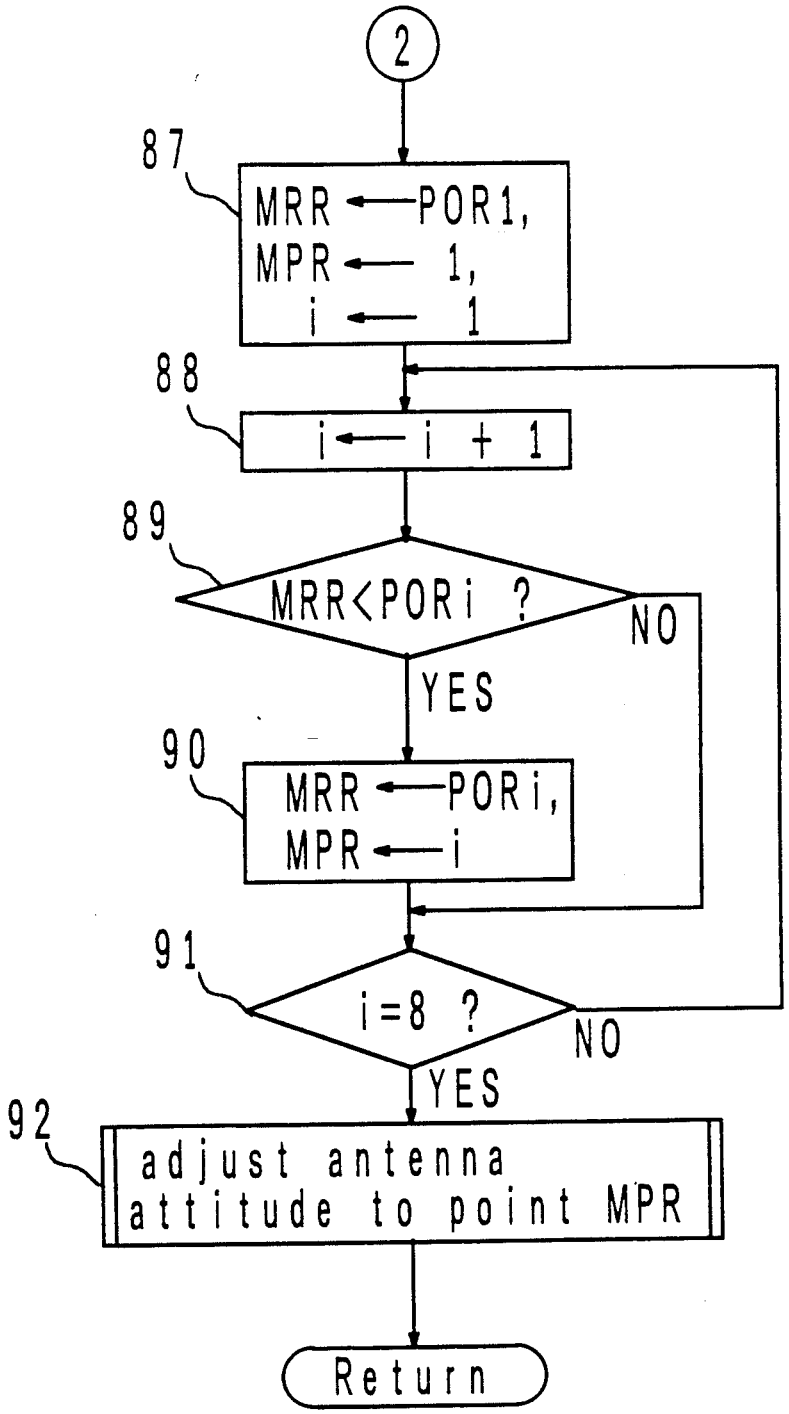
FIG. 16 is a flow chart illustrating the operation of the microcomputer 1 in the second embodiment of the invention, corresponding to FIG. 8*b* associated with the first embodiment.

It is to be noted that in the second embodiment, after the completion of the single cycle conical scan over the small range according to the reception tracking routine 15 and when the reception levels from all of eight points (points 1 to 8 shown in FIG. 13) are stored into registers POR1 to 8, the operation shown in FIG. 16 is executed in place of the operation shown in FIG. 8*b* for the first embodiment. Specifically, reception levels from point 1 to point 8 are compared against each other to determine a point where the maximum reception level has been obtained (S87 to S91). The attitude of the antenna 30 is adjusted to bring the center of rotation of the antenna beam to the maximum point thus determined (S92). If the point a shown in FIG. 13 represents the true position of the source of radio wave, the magnitude of the reception levels will be such that point 1>point 2>point 8>point 3>point 7>point 4>point 6>point 5, and hence the point where the maximum reception level is obtained is represented by point 1. Accordingly, the attitude of the antenna 30 is adjusted to bring the directivity of the antenna into alignment with point 1. A calculation of a difference between the maximum and the minimum value of the reception levels and an updating of the first reference TH1 when the difference is small which have been conducted in the first embodiment are omitted in the second embodiment. These are the differences of the second embodiment a compared with the first embodiment, and in other respects, the operation is similar.

In the second embodiment, (IB) when the reception level from the antenna is at or above a given value TH1, the directivity of the antenna is controlled so as to compensate for a movement of the moving vehicle only using gyro data.

(IIB) When the reception level from the antenna is less than the first reference TH1 and is equal to or above the second reference value TH2 or the lower limit for the reception level, the directivity of the antenna is controlled so as to compensate for a movement of the moving vehicle, and simultaneously the reception tracking operation is performed in which the directivity of the antenna is controlled to achieve a higher reception level by the small range scan. In this manner, any offset in the attitude which may be caused by an error contained in the data detected by gyro is corrected for. (IIIB) When the reception level from the antenna drops below the second reference, gyro data is utilized to control the directivity of the antenna so as to compensate for a movement of the moving vehicle, and simultaneously the tracking search operation is performed in which the directivity of the antenna is scanned over a range which is broader than that of the small range scan. As a consequence, if a temporary failure of the reception occurs due to a time delay in the tracking control, a response delay in the tracking mechanism or under the influence of any obstacle, a search conducted over a broader range enables the radio wave to be caught again automatically, thus avoiding a complete loss of the radio wave. A practical reception is enabled by using a drive unit of a small size and a low output, enabling a compact and light weight system to be implemented which is required for a mobile application. (IVB) In addition, when the reception level from the antenna is high and the tracking operation (IB) continues over a given time interval, or when the tracking operation responsive to gyro data alone takes place in a stable manner, the start point for the gyro as well as a variance therefrom are automatically initialized, preventing any accumulated error in the values detected by the gyro from increasing excessively. In this manner, the tracking operation (IB) is allowed to continue over a prolonged length of time, and the setting of the optimum directivity is rapidly achieved by the operation (IIB), reducing the number of times such operation (IIB) must be repeated.

From the above disclosure, it will be readily seen that the invention is equally applicable to a mobile body other than road vehicles such as marine vessels, aircrafts or the like.

While preferred embodiments of the invention have been illustrated and described, it is to be understood that there is no intention to limit the invention to the precise constructions disclosed herein and that the right is reserved to all changes and modifications coming within the scope of invention as defined in the appended claims.

What is claimed is:

1. An attitude control system for mobile antenna comprising an antenna supported on a moving vehicle so as to be capable of changing its attitude;

a drive mechanism for altering the attitude of the antenna;

reception level detecting means for detecting a reception level from the antenna;

and electronic control means responsive to a reception level detected by the reception level detecting means for performing a small range scan control which is conducted when the reception level is less than a first reference and at or above a second reference for scanning the antenna over a small range through the drive mechanism and for altering the attitude of the antenna in a direction which is found during the scan to provide a higher reception level, for performing a search control which is conducted when the reception level is less than the second reference for scanning the antenna over a broader range than that of the small range scan through the drive mechanism, and for detecting a fluctuation of the reception level during the small range scan and for updating the first reference to a value which is slightly less than a high value obtained during the small range scan when the fluctuation is less than a third reference.

2. An attitude control system for a mobile antenna comprising an antenna mounted on a moving vehicle so as to be capable of changing its attitude;

a drive mechanism for altering the attitude of the antenna;

reception level detecting means for detecting a reception level from the antenna;

attitude detecting means for detecting a variance in the attitude of the moving vehicle from a start point thereof;

and electronic control means responsive to a change detected by the attitude detecting means for altering the attitude of the antenna through the drive mechanism so as to compensate for an offset in the directivity of the antenna which is caused by the detected change in the attitude of the moving vehicle, the electronic control means being responsive to a reception level detected by the reception level detecting means for performing a small range scan control which is conducted when the reception level is less than a first reference and at or above a second reference for scanning the antenna over a small range through the drive mechanism and for altering the attitude of the antenna to a direction which is found during the scan to provide a higher reception level, for performing a search control which is conducted when the reception level is less than the second reference for scanning the antenna through the drive mechanism over a broader range than that of the small range scan, and for detecting a fluctuation in the reception level which occurs during the small range scan and for updating the first reference to a value which is slightly less than a high value obtained during the small range scan when the fluctuation is less than a third reference.

3. An attitude control system for mobile antenna comprising an antenna mounted on a moving vehicle so as to be capable of changing its attitude;

a drive mechanism for altering the attitude of the antenna;

reception level detecting means for detecting a reception level from the antenna;

attitude detecting means for detecting a variance in the attitude of the moving vehicle from a start point thereof;

and electronic control means for performing a first control in which the attitude of the antenna is altered by the drive mechanism so as to compensate for an offset in the directivity of the antenna which is caused by a change detected by the attitude detecting means, a second control which is responsive to a reception level detected by the reception level detecting means for scanning the antenna over a small range through the drive mechanism and for altering the attitude of the antenna to a direction which is found during the scan to provide a higher reception level when the reception level is less than a first reference and at or above a second reference, a third control responsive to a reception level detected by the reception level detecting means for scanning the antenna through the drive mechanism over a broader range than that of the small range scan when the reception level is less than the second reference, and a fourth control responsive to a reception level detected by the reception level detecting means for initializing a start point and a variance from the start point for the attitude detecting means to compensate for any accumulated error in the variance at a given time interval as long as the reception level is at or above a given value.

* * * * *